US012121102B2

(12) United States Patent
Bailly et al.

(10) Patent No.: US 12,121,102 B2
(45) Date of Patent: Oct. 22, 2024

(54) FOOT SUPPORT SYSTEMS INCLUDING FLUID FILLED BLADDERS WITH MOVEMENT OF FLUID BETWEEN BLADDERS

(71) Applicant: NIKE, Inc., Beaverton, OR (US)

(72) Inventors: Devin Bailly, Portland, OR (US); Elizabeth Langvin, Sherwood, OR (US); Levi J. Patton, Portland, OR (US); Adam Vollmer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/976,042

(22) Filed: Oct. 28, 2022

(65) Prior Publication Data

US 2023/0048198 A1 Feb. 16, 2023

Related U.S. Application Data

(62) Division of application No. 16/698,138, filed on Nov. 27, 2019, now Pat. No. 11,510,458.

(60) Provisional application No. 62/772,786, filed on Nov. 29, 2018.

(51) Int. Cl.
*A43B 13/20* (2006.01)
*A43B 7/1455* (2022.01)

(52) U.S. Cl.
CPC ..... *A43B 13/203* (2013.01); *A43B 7/1455* (2013.01)

(58) Field of Classification Search
CPC ..... A43B 7/1455; A43B 13/127; A43B 13/20; A43B 13/203; A43B 13/206
See application file for complete search history.

(56) References Cited

U.S. PATENT DOCUMENTS

| | | | | |
|---|---|---|---|---|
| 5,319,866 | A * | 6/1994 | Foley | A43B 5/00 36/31 |
| 5,771,606 | A | 6/1998 | Litchfield et al. | |
| 5,893,219 | A | 4/1999 | Smith et al. | |
| 6,354,020 | B1 * | 3/2002 | Kimball | A43B 13/203 36/35 B |
| 6,453,577 | B1 | 9/2002 | Litchfield et al. | |
| 7,204,041 | B1 * | 4/2007 | Bailey, Sr. | A43B 7/06 36/1 |
| 7,210,249 | B2 * | 5/2007 | Passke | A43B 13/206 36/29 |

(Continued)

FOREIGN PATENT DOCUMENTS

| | | |
|---|---|---|
| CN | 1372443 A | 10/2002 |
| CN | 1213672 C | 8/2005 |

(Continued)

OTHER PUBLICATIONS

Mar. 17, 2020—(WO) ISR & WO—App. No. PCT/US19/063625.
Mar. 7, 2024—(EP) Communication with European Search Report—App. 23215859.2, 7 pages.

*Primary Examiner* — Sharon M Prange
(74) *Attorney, Agent, or Firm* — Banner & Witcoff, Ltd.

(57) ABSTRACT

Sole structures, fluid transfer systems, foot support systems, articles of footwear, and/or other foot-receiving devices include one or more pumps (e.g., foot activated pumps) that facilitate movement of fluid within the sole structure/article of footwear, e.g., to change and/or control pressure (e.g., foot support pressure) in one or more fluid filled bladders included in the overall system.

20 Claims, 14 Drawing Sheets

(56) References Cited

U.S. PATENT DOCUMENTS

| | | | | |
|---|---|---|---|---|
| 7,254,903 | B2 * | 8/2007 | Cho | A43B 7/081 36/3 R |
| 7,409,779 | B2 | 8/2008 | Dojan et al. | |
| 7,448,150 | B1 * | 11/2008 | Davis | A43B 13/203 36/35 B |
| 8,015,730 | B2 * | 9/2011 | Hazenberg | A43B 13/203 36/35 B |
| 8,850,718 | B2 | 10/2014 | Lubart | |
| 8,914,994 | B2 * | 12/2014 | James | A43B 7/142 36/28 |
| 2010/0251567 | A1 | 10/2010 | McInnis et al. | |
| 2012/0255195 | A1 * | 10/2012 | Langvin | A43B 13/186 36/29 |
| 2013/0118029 | A1 | 5/2013 | Kim | |
| 2013/0212909 | A1 * | 8/2013 | Bates | A43B 13/203 36/102 |
| 2014/0075777 | A1 | 3/2014 | Bruce et al. | |
| 2015/0305436 | A1 | 10/2015 | Doyle | |
| 2019/0200701 | A1 * | 7/2019 | Lo | A43B 13/203 |
| 2020/0046071 | A1 * | 2/2020 | Henrichot | A43B 3/38 |
| 2020/0367606 | A1 * | 11/2020 | Bailly | F16K 31/52416 |

FOREIGN PATENT DOCUMENTS

| | | | |
|---|---|---|---|
| CN | 100407955 | C | 8/2008 |
| CN | 102548441 | A | 7/2012 |
| CN | 204357677 | | 5/2015 |
| DE | 1287477 | B | 1/1969 |
| EP | 0629360 | A1 | 12/1994 |
| GB | 2114425 | A | 8/1983 |
| KR | 100475145 | B1 | 3/2005 |
| KR | 101837120 | B1 | 3/2018 |
| TW | 24938 | B | 6/1994 |
| TW | 200722620 | A | 6/2007 |
| TW | M547865 | | 9/2017 |
| WO | 9118527 | A1 | 12/1991 |
| WO | 9809546 | A1 | 3/1998 |

* cited by examiner

FOOT SUPPORT SYSTEMS INCLUDING FLUID FILLED BLADDERS WITH MOVEMENT OF FLUID BETWEEN BLADDERS

RELATED APPLICATION DATA

This application is a divisional of co-pending U.S. patent application Ser. No. 16/698,138 filed Nov. 27, 2019, which application is a U.S. Non-Provisional Application and claims priority benefits based on U.S. Provisional Patent Appln. No. 62/772,786 filed Nov. 29, 2018. Each of U.S. patent application Ser. No. 16/698,138 and U.S. Provisional Patent Appln. No. 62/772,786 is entirely incorporated herein by reference. Additional aspects and features of this invention may be used in conjunction with the systems and methods described in: (a) U.S. Provisional Patent Appln. No. 62/463,859 filed Feb. 27, 2017; (b) U.S. Provisional Patent Appln. No. 62/463,892 filed Feb. 27, 2017; (c) U.S. Provisional Patent Appln. No. 62/850,140, (d) U.S. Provisional Patent Appln. No. 62/678,662 filed May 31, 2018, and (e) U.S. patent application Ser. No. 16/425,356 filed May 29, 2019. Each of U.S. Provisional Patent Appln. No. 62/463,859, U.S. Provisional Patent Appln. No. 62/463,892, U.S. Provisional Patent Appln. No. 62/850,140, U.S. Provisional Patent Appln. No. 62/678,662, and U.S. patent application Ser. No. 16/425,356 is entirely incorporated herein by reference.

FIELD OF THE INVENTION

The present invention relates to foot support systems in the field of footwear or other foot-receiving devices. At least some aspects of the present invention pertain to sole structures, fluid transfer systems, foot support systems, articles of footwear, and/or other foot-receiving devices that include one or more pumps (e.g., foot activated pumps) that facilitate movement of fluid within the sole structure/article of footwear, e.g., to change and/or control pressure (e.g., foot support pressure) in one or more fluid filled bladders included in the overall system.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as running shoes, golf shoes, tennis shoes, baseball cleats, soccer or football cleats, ski boots, basketball shoes, cross training shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

SUMMARY

This Summary is provided to introduce some general concepts relating to this technology in a simplified form that are further described below in the Detailed Description. This Summary is not intended to identify key features or essential features of the invention.

Aspects of this technology relate to sole structures, fluid transfer systems, foot support systems, articles of footwear, and/or other foot-receiving devices, e.g., of the types described and/or claimed below and/or of the types illustrated in the appended drawings. Such sole structures, fluid transfer systems, foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

More specific aspects of this technology relate to sole structures, fluid transfer systems, foot support systems, articles of footwear, and/or other foot-receiving devices that include one or more pumps (e.g., foot activated pumps) that facilitate movement of fluid within the sole structure/article of footwear/foot-supporting member/foot-receiving device, e.g., to change and/or control pressure (e.g., foot support pressure) in one or more fluid filled bladders included in the overall system.

While aspects of the technology are described in terms of foot support systems and articles of footwear including them, additional aspects of this technology relate to methods of making such foot support systems and/or articles of footwear and/or methods of using such foot support systems and/or articles of footwear to support a wearer's foot.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
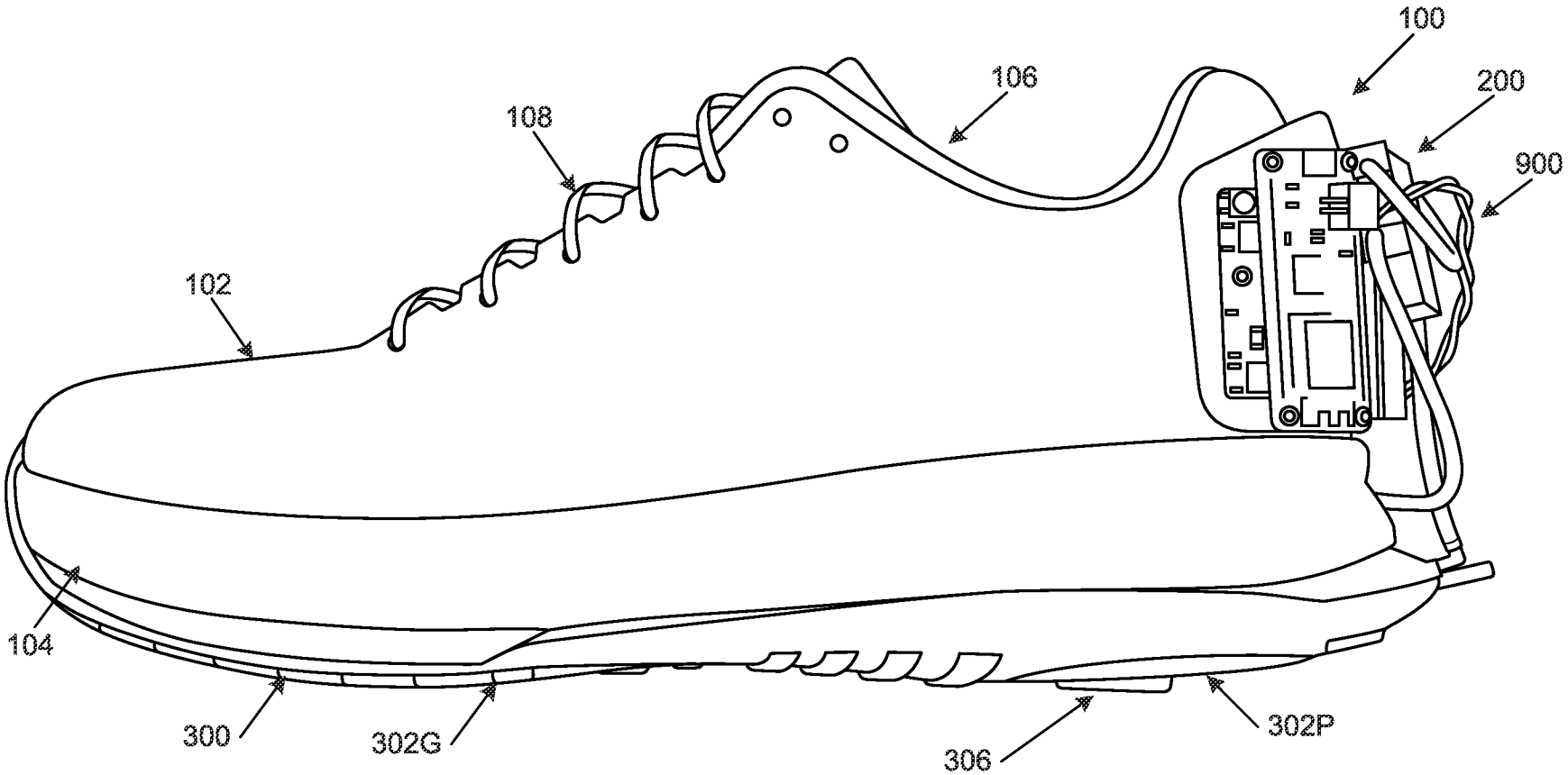
FIGS. 1A-1H provide various views of an article of footwear and/or various components thereof in accordance with some examples of this technology.

In the following description of various examples of footwear structures and components according to the present technology, reference is made to the accompanying drawings, which form a part hereof, and in which are shown by way of illustration various example structures and environments in which aspects of the present technology may be practiced. It is to be understood that other structures and environments may be utilized and that structural and functional modifications may be made to the specifically described structures, functions, and methods without departing from the present technology.

I. GENERAL DESCRIPTION OF ASPECTS OF THIS TECHNOLOGY

As noted above, aspects of this technology relate to fluid transfer systems, foot support systems, articles of footwear, and/or other foot-receiving devices, e.g., of the types described and/or claimed below and/or of the types illustrated in the appended drawings. Such fluid transfer systems, foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Some more specific aspects or examples of this technology relate to sole structures for articles of footwear that include: (a) a first pump having a first inlet and a first outlet in fluid communication with a first internal pump chamber defined by the first pump, wherein the first internal pump chamber includes an open space defined, at least in part, between a first wall and a second wall located opposite the first wall, and wherein at least one of the first wall or the second wall is collapsible to decrease volume of the first internal pump chamber and force fluid to exit the first internal pump chamber via the first outlet; (b) a first sole component (e.g., an outsole component or a foot support plate) having a first major surface and a second major surface opposite the first major surface, wherein the second major surface includes a first pump containing region, and wherein the first pump containing region defines a first pump engaging surface configured to lie immediately adjacent an exterior side of the first wall of the first internal pump chamber; and (c) a second sole component (e.g., a midsole component or a foot support plate) having a third major surface and a fourth major surface opposite the third major surface, wherein the fourth major surface includes a second pump containing region, and wherein the second pump containing region defines a second pump engaging surface configured to lie immediately adjacent an exterior side of the second wall of the first internal pump chamber. The first pump's first outlet may be in fluid communication with one or more of a fluid filled bladder (e.g., a foot support bladder, a reservoir bladder, etc.), a fluid transfer line, another pump, etc.

In some examples of these aspects/examples of the technology, the sole structures further may include a second pump having a second inlet and a second outlet in fluid communication with a second internal pump chamber defined by the second pump, wherein the second internal pump chamber includes an open space defined, at least in part, between a third wall and a fourth wall located opposite the third wall, wherein at least one of the third wall or the fourth wall is collapsible to decrease volume of the second internal pump chamber and force fluid to exit the second internal pump chamber via the second outlet. This second inlet of the second pump may be in fluid communication with the first outlet of the first pump (e.g. via a fluid transfer line) to admit fluid pumped from the first pump into the second internal pump chamber. In this manner, the first pump may pump fluid into the second pump internal pump chamber. The second outlet of the second pump may be in fluid communication with one or more of a fluid filled bladder (e.g., a reservoir bladder, a foot support bladder, etc.), a fluid transfer line, and/or even another pump. In structures including a fluid filled bladder, this fluid filled bladder may be a reservoir bladder (e.g., included in a footwear upper and/or sole structure), and that reservoir fluid filled bladder may be in fluid communication (e.g., via a programmable control valve) with a foot support bladder. The second pump may be incorporated into a sole structure in a similar manner to that described above for the first pump (e.g., between major surfaces of sole components, within pump containing region(s) in the sole component(s), engaged with pump engaging surface(s) of the sole component(s), etc.).

Additional examples and aspects of this technology relate to fluid transfer systems, e.g., for moving fluid within articles of footwear (e.g., for foot support systems). Such fluid transfer systems may include: (a) a first pump including a first pump chamber, a first inlet, and a first outlet; (b) a first fluid transfer line connected to the first inlet and connecting the first pump with an external fluid source, wherein the first fluid transfer line moves fluid from the external fluid source into the first pump chamber via the first inlet; (c) a second pump including a second pump chamber, a second inlet, and a second outlet; (d) a second fluid transfer line connected to the second inlet and admitting fluid discharged from the first outlet of the first pump into the second pump chamber via the second inlet; (e) a third fluid transfer line connected to the second outlet and receiving fluid discharged from the second pump chamber; and (f) a fluid-filled bladder (e.g., a reservoir bladder and/or a foot support bladder) in fluid communication with the third fluid transfer line and receiving fluid discharged from the second pump chamber via the second outlet. In these examples/aspects, the fluid transfer system may further include: (a) a first valve, e.g., provided in the first fluid transfer line, to allow fluid to move from the external fluid source to the first inlet and to inhibit fluid from moving from the first inlet through the first valve (e.g., back to the external fluid source) and/or (b) a second valve, e.g., provided in the second fluid transfer line, to allow fluid to move from the second fluid line to the second inlet and to inhibit fluid from moving from the second inlet through the second valve (e.g., back into the second fluid line and/or the first pump).

Still additional examples and aspects of this technology relate to foot support systems that include: (a) a fluid-filled bladder having an interior volume for containing fluid, a first longitudinal area, and a second longitudinal area located forward of the first longitudinal area; (b) a first pump including a first pump chamber, a first inlet, and a first outlet, wherein the first pump is located at or adjacent the first longitudinal area of the fluid-filled bladder; (c) a first fluid transfer line connected to the first inlet and connecting the first pump with an external fluid source (e.g., ambient air), wherein the first fluid transfer line moves fluid from the external fluid source into the first pump chamber via the first inlet; (d) a second pump including a second pump chamber, a second inlet, and a second outlet, wherein the second pump is located at or adjacent the second longitudinal area of the fluid-filled bladder; (e) a second fluid transfer line connected to the second inlet and admitting fluid discharged from the first outlet into the second pump chamber via the second inlet; and (f) a third fluid transfer line connected to the second outlet and receiving fluid discharged from the second pump chamber, wherein the fluid-filled bladder is in fluid communication with the second pump at least in part via the third fluid transfer line. The fluid-filled bladder may be a foot support bladder and/or a reservoir bladder. As another option or alternative, these example foot support systems further may include a second fluid-filled bladder and a fluid transfer control system connecting the fluid-filled bladder with the second fluid-filled bladder (e.g., to enable change and/or control of fluid pressure in one or more of these bladders).

Additional examples and aspects of this technology relate to articles of footwear and/or other foot-receiving devices that include sole structures, fluid transfer systems, and/or foot support systems of any of the various examples and aspects described above. Still additional examples and aspects of this technology relate to methods of making such sole structures, fluid transfer systems, foot support systems, articles of footwear, and/or foot-receiving devices and/or methods of using such sole structures, fluid transfer systems, foot support systems, articles of footwear, and/or foot-receiving devices, e.g., to support a wearer's foot.

Given the general description of features, examples, aspects, structures, processes, and arrangements according to certain examples of this technology provided above, a more detailed description of specific example foot support structures, articles of footwear, and methods in accordance with this technology follows.

II. DETAILED DESCRIPTION OF EXAMPLE ARTICLES OF FOOTWEAR, FOOT SUPPORT SYSTEMS, AND OTHER COMPONENTS/FEATURES ACCORDING TO THIS TECHNOLOGY

Referring to the figures and following discussion, various examples of foot support systems, fluid transfer systems, sole structures, and articles of footwear in accordance with aspects of this technology are described. Aspects of this technology may be used in conjunction with foot support systems, articles of footwear (or other foot-receiving devices), and/or methods, for example, those described below and/or those described in U.S. Provisional Patent Appln. No. 62/463,859 and/or U.S. Provisional Patent Appln. No. 62/463,892.

FIG. 1A provides a side view of an example article of footwear 100 in accordance with at least some aspects of this technology. The article of footwear 100 includes an upper 102 and a sole structure 104 engaged with the upper 102. The upper 102 may be made of any desired materials, including conventional materials as are known and used in the footwear arts. Examples of suitable materials for the upper 102 include one or more of: woven fabric, knitted fabric, leather (natural or synthetic), canvas, polyester, cotton, other fabrics or textiles, thermoplastic polyurethanes, etc. The upper 102 defines a foot insertion opening 106 that allows access to a foot-receiving chamber defined at least in part by the upper 102 and/or the sole structure 104. A closure system 108 (e.g., a lace and lacing system, one or more straps, a zipper, etc.) is provided to releasably secure the article of footwear 100 to a wearer's foot (e.g., in a conventional manner).

Each of the upper 102 and the sole structure 104 may be formed from one or more component parts. When formed of multiple component parts, these component parts may be engaged together in any desired manner, including via one or more of: adhesives or cements; sewn seams; mechanical connectors; fusing techniques; and/or other manners, including in conventional manners as are known and used in the footwear arts. Likewise, the upper 102 and sole structure 104 may be engaged together in any desired manner, including via one or more of: adhesives or cements; sewn seams; mechanical connectors;

fusing techniques; and/or other manners, including in conventional manners as are known and used in the footwear arts.

The article of footwear 100 of FIG. 1A includes features of a foot support system (e.g., at least partially included with the sole structure 104) and a fluid transfer system (a portion of which is shown at element 200 in FIG. 1A) in accordance with examples and aspects of this technology. A more detailed description of example foot support systems and fluid transfer systems in accordance with aspects of this technology will be described in more detail below in conjunction with FIGS. 1A-6.

Figure 1B:
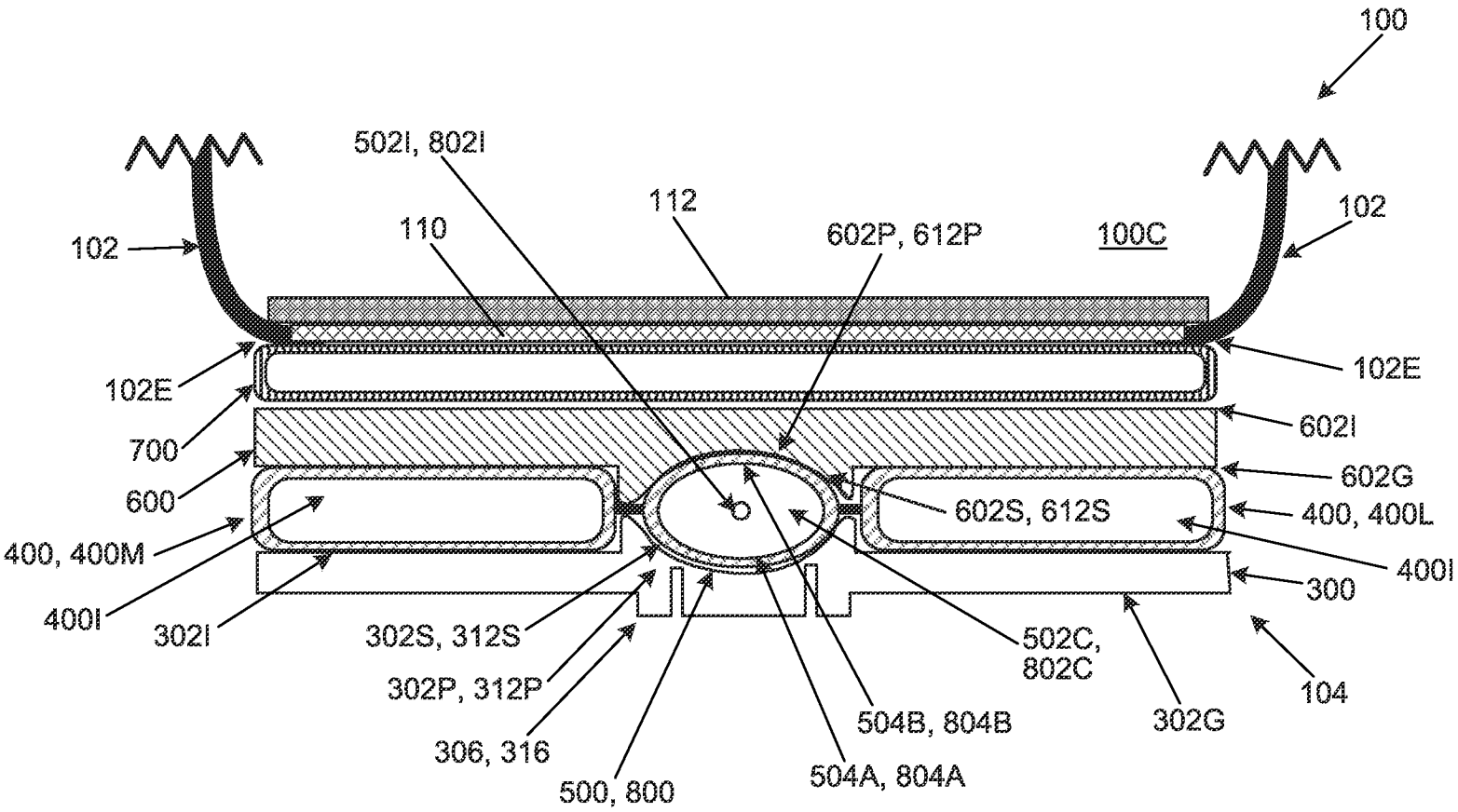

FIG. 1B provides a transverse (medial side-to-lateral side), vertical cross-sectional view of an example article of footwear 100 through a pump structure 500, 800. FIG. 1B includes a general example arrangement of example component parts of an article of footwear 100 and sole structure 104 in accordance with some examples of this technology. This example article of footwear 100 includes upper 102 having its bottom edges 102E connected to a strobel member 110 (e.g., by stitching, adhesives, mechanical connectors, fusing techniques, etc.). The strobel member 110 closes off the bottom of the upper 102 (and partially defines the foot-receiving chamber 100C of the footwear 100). The bottom of the strobel member 110 is engaged with a sole structure 104 (optionally fixed in any desired manner, including by stitching, adhesives, mechanical connectors, fusing techniques, etc.). A sock liner 112 or insole element may be provided in the interior foot-receiving chamber 100C.

This example sole structure 104 includes: (a) a first sole component 300 (e.g., an outsole or other foot support plate); (b) a first fluid-filled bladder 400 (e.g., a reservoir bladder, a foot support bladder, etc.); (c) a first pump 500, 800 (e.g., located in a heel area, a forefoot area, a midfoot area, etc.); (d) a second sole component 600 (e.g., a midsole or a foot support plate); and (e) a second fluid-filled bladder 700 (e.g., a reservoir bladder, a foot support bladder, etc.).

Figure 1C:
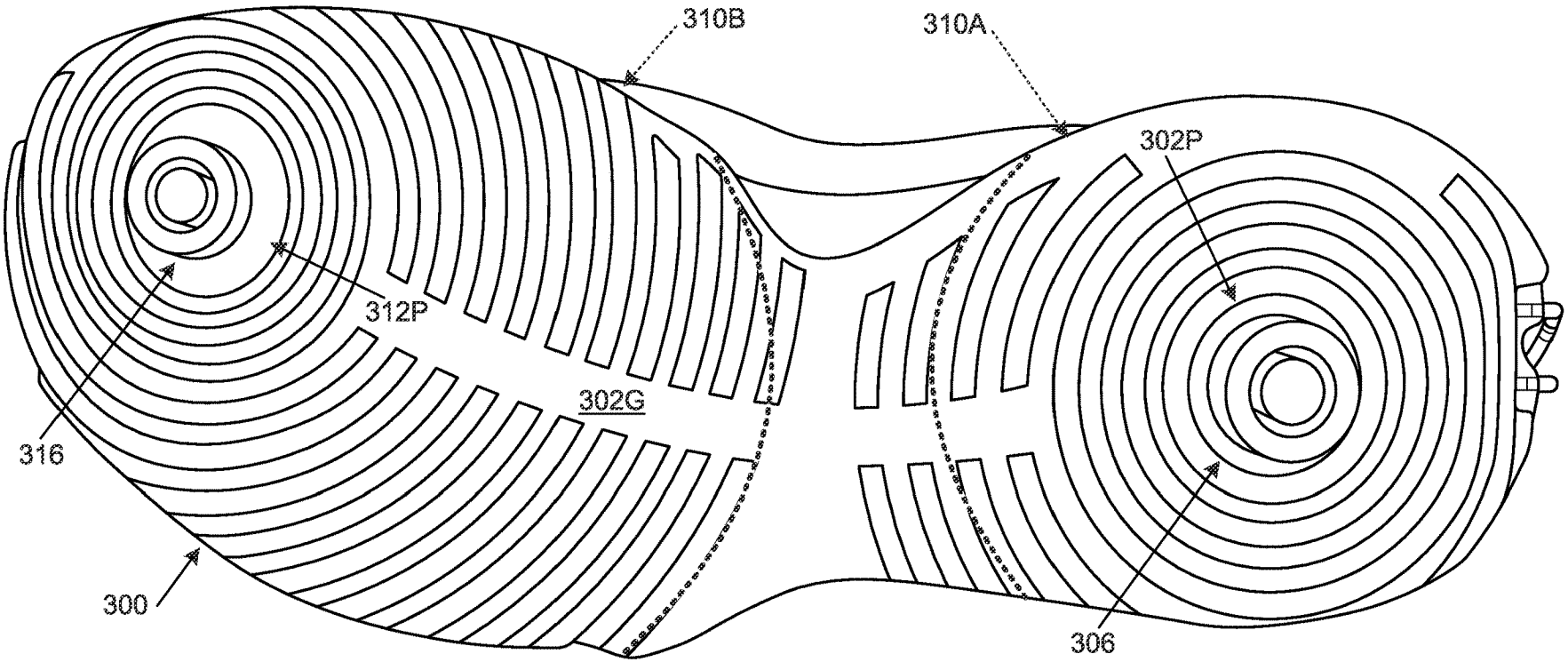
Figure 1D:
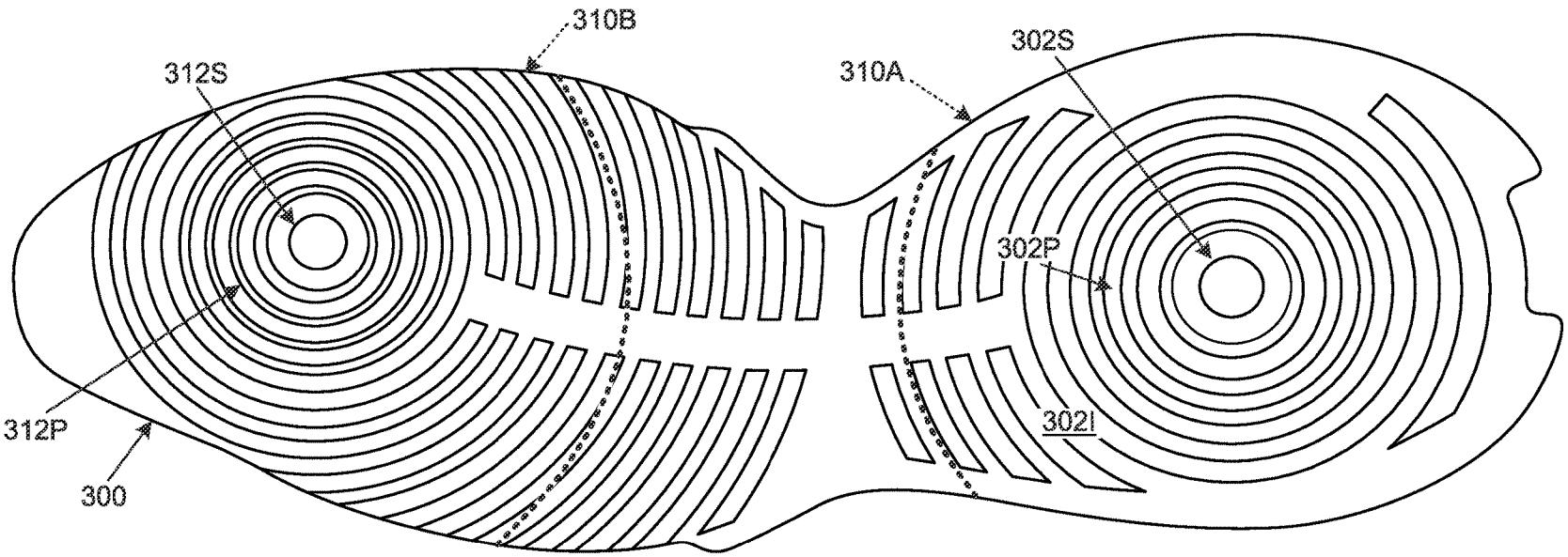
Figure 1E:
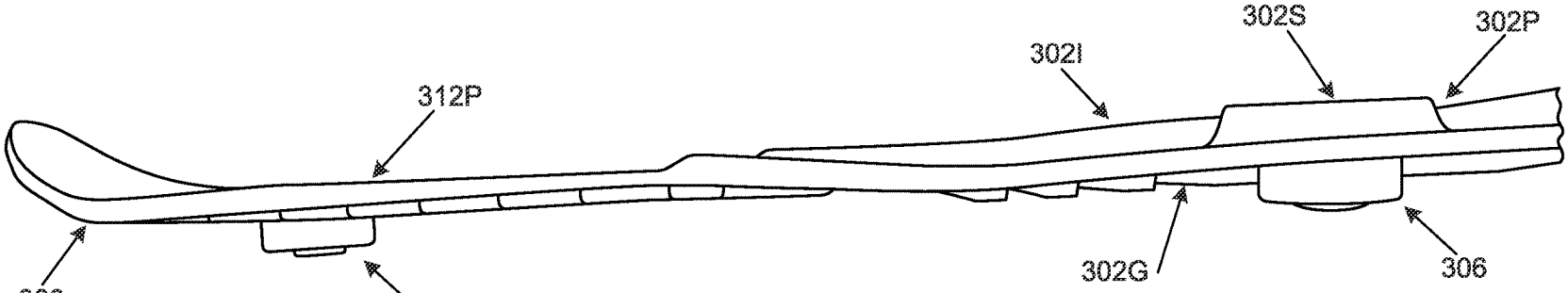
Figure 1F:
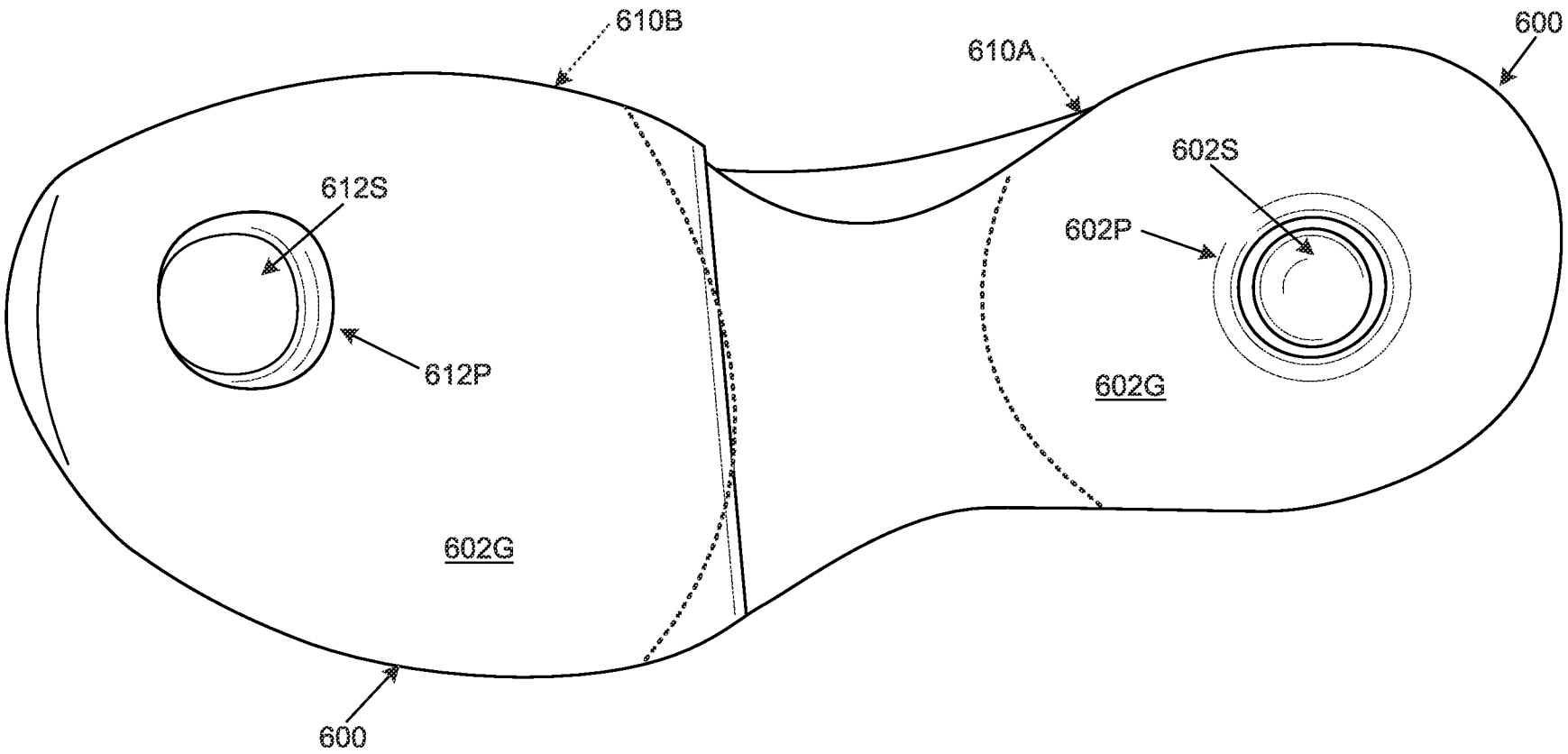
Figure 1G:
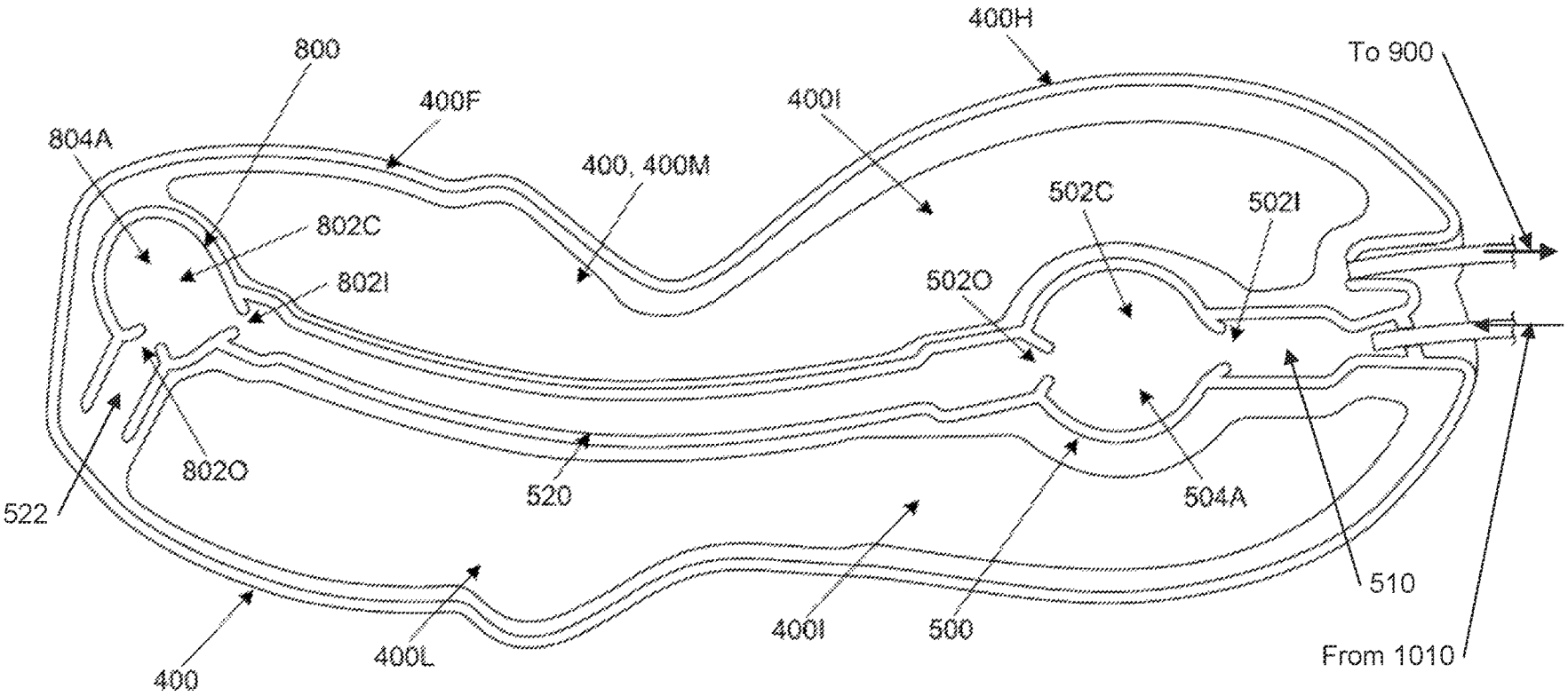
Figure 1H:
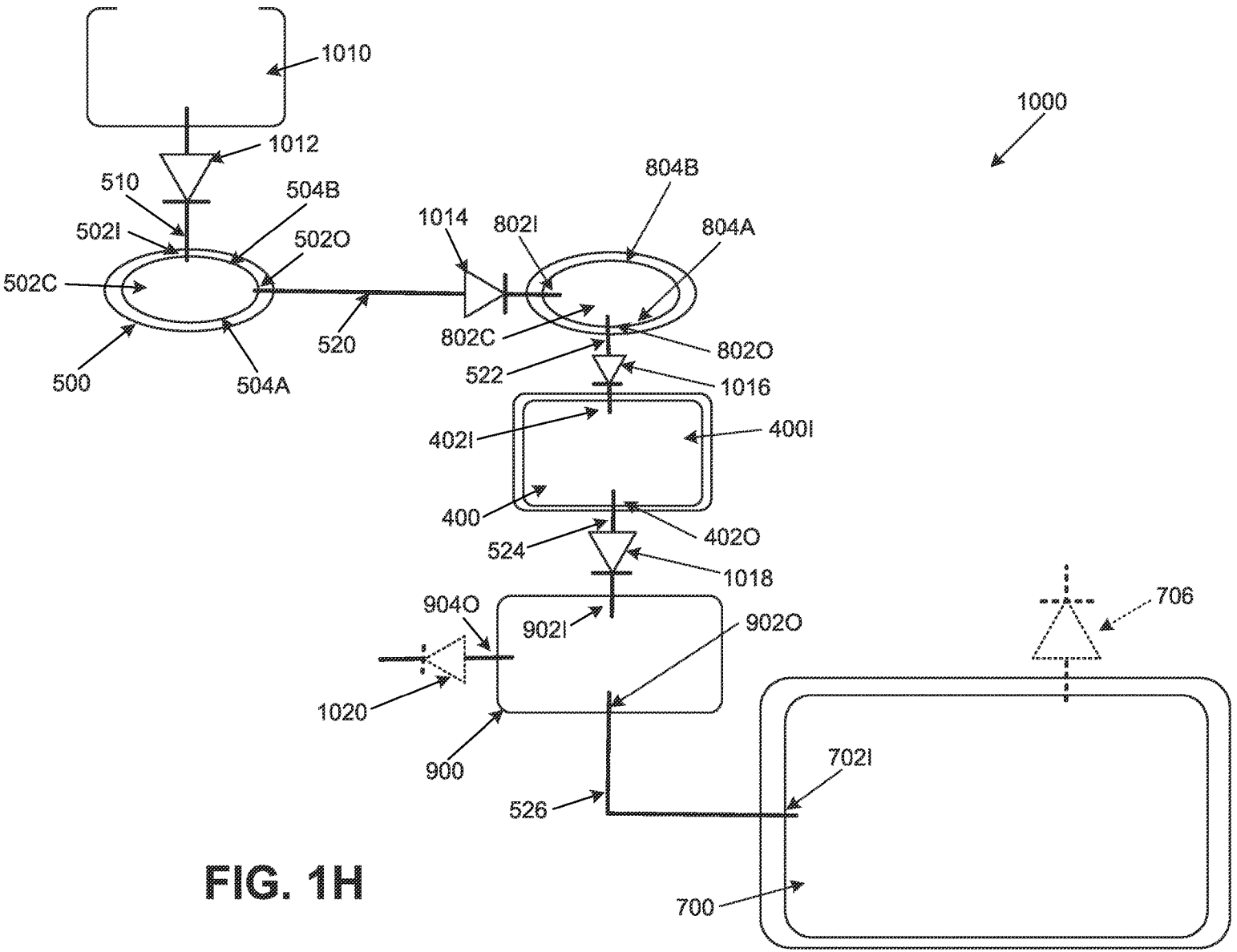

FIGS. 1C, 1D, and lE provide bottom, top, and side views, respectively, of an outsole 300 of this example article of footwear 100 and sole structure 104. This outsole 300 may be formed of any desired materials, including rubber, thermoplastic polyurethanes, other thermoplastic or thermosetting polymers, and/or other suitable materials and/or structures, including materials and/or structures that are known and used in the footwear arts. FIG. 1F provides a bottom view of a midsole 600. The midsole 600 may be formed of any desired materials, including polymeric foam materials such as ethylvinylacetate (EVA) foams, polyurethane foams, or the like; rubber materials; thermoplastic polyurethane materials; and/or other suitable impact force attenuating materials and/or structures, including materials and/or structures that are known and used in the footwear arts Additionally or alternatively, element 600 may constitute or include a relatively rigid foot support plate, e.g., used to separate bladder 400 and foot support bladder 700. FIG. 1G provides a plan view of a fluid-filled bladder, e.g., bladder 400 (e.g., a reservoir bladder), which in this illustrated example is integrally formed with first pump 500 and second pump 800. FIG. 1H provides a schematic view of the overall fluid transfer system and foot support system of this specific example structure.

As shown in FIGS. 1B and 1H (but also shown at least in part in other figures), this example sole structure 104 for article of footwear 100 includes a first pump 500 having a first inlet 502I and a first outlet 502O in fluid communication with a first internal pump chamber 502C defined by the first pump 500. This first pump 500 and first internal pump chamber 502C define an open space, at least in part, between a first wall 504A and a second wall 504B located opposite the first wall 504A. At least one (and optionally both) of the first wall 504A and/or the second wall 504B is collapsible to decrease volume of the first internal pump chamber 502C and force fluid to exit the first internal pump chamber 502C via the first outlet 502O.

As further shown in FIG. 1B, the bottom of the first pump 500 (e.g., first wall 504A) is at least partially covered by (and optionally completely covered by) first sole component 300, which in this illustrated example is an outsole component. First sole component 300 has a first major surface 302G (e.g., a ground contacting or ground facing surface, optionally with traction elements integrally formed or attached thereto) and a second major surface 3021 opposite the first major surface 302G. The second major surface 3021 further defines a first pump containing region 302P, and this first pump containing region 302P defines a first pump engaging surface 302S configured to lie immediately adjacent (and optionally into contact with) an exterior side of the first wall 504A of the first internal pump chamber 502C. If desired, as shown in the various figures, if the first major surface 302G of the first sole component 300 (e.g., an outsole component) is a ground facing surface of the sole structure 104, this first major surface 302G further may include a first protrusion 306 located opposite the first pump engaging surface 302S. This first protrusion 306 may extend outward from a bottom base surface of the ground facing surface 302G and may help activate (e.g., compress) the first pump 500 when the sole structure 104 (e.g., the first major surface 302G of the first sole component 300) contacts the ground in use (e.g., when a wearer's foot contacts the ground during a step). Note also FIGS. 1C and 1E.

In a similar manner, the top of the first pump 500 (e.g., the second wall 504B) is at least partially covered by (and optionally completely covered by) second sole component 600, which in this illustrated example is a midsole component. This second sole component 600 has a third major surface 602I and a fourth major surface 602G opposite the third major surface 602I. The fourth major surface 602G of this illustrated example includes a second pump containing region 602P, and this second pump containing region 602P defines a second pump engaging surface 602S configured to lie immediately adjacent (and optionally in contact with) an exterior side of the second wall 504B of the first internal pump chamber 502C.

As shown by FIGS. 1B, 1D, 1F, 1G, and 1H, the first internal pump chamber 502C has an ellipsoidal and/or spheroidal shape. Also, each of the first pump engaging surface 302S (of the first sole component 300) and the second pump engaging surface 602S (of the second sole component 600) has a semi-ellipsoidal and/or semi-spheroidal shape (e.g., approximately half-ellipsoidal and/or half-spheroidal shaped). One or both of the pump engaging surfaces 302S and/or 602S may directly contact the exterior sides of pump walls 504A and/or 504B, respectively, of the first pump chamber 502C. Optionally, if desired, one or both of the pump engaging surfaces 302S and/or 602S may be fixed to the exterior sides of pump walls 504A and/or 504B, respectively, of the first pump chamber 502C (e.g., by adhesives or cements) so that the pump walls 504A and/or 504B will move (inward and outward) as the first sole component 300 and second sole component 600 move (compress and expand) with respect to one another (e.g., to compress and expand the pump chamber 502C). This "fixed" feature may be particularly useful to pull the opposite pump walls 504A/504B apart (and consequently pull new fluid (e.g., air) into the pump chamber 502C through the inlet 502I) as the first sole component 300 and the second sole component 600 return and/or re-expand to their original positions after the user's weight is lifted off pump 500 during a step cycle.

The above description of the structural relationship between the first sole component 300 (e.g., an outsole), the second sole component 600 (e.g., a midsole), and the first pump 500 relates to structures provided at a heel based area of the sole structure 104 (and activated by a heel strike of a wearer's foot) in this example. The second pump 800, provided in the forefoot area of this example sole structure 104 (and activated by a toe-off action of a wearer's foot during a step cycle), may have a similar arrangement and/or structure as first pump 500 and/or a similar relationship with respect to the first sole component 300 and/or the second sole component 600. For example, as shown in FIGS. 1B and 1H (but also shown at least in part in other figures), this second pump 800 has a first inlet 802I and a first outlet 802O in fluid communication with a second internal pump chamber 802C defined by the second pump 800. This second pump 800 and second internal pump chamber 802C define an open space, at least in part, between a third wall 804A and a fourth wall 804B located opposite the third wall 804A. At least one (and optionally both) of the third wall 804A and/or the fourth wall 804B is collapsible to decrease volume of the second internal pump chamber 802C and force fluid to exit the second internal pump chamber 802C via the second outlet 802O. In at least some examples of this invention, the second inlet 802I of the second pump 800 will be in fluid communication with the first outlet 502O of the first pump 500 to admit fluid pumped from the first pump 500 into the second internal pump chamber 802C. The first outlet 502O and second inlet 802I may be joined by a first fluid transfer line 520 having its first end engaged with the first outlet 502O and its second end engaged with the second inlet 802I.

As further shown in FIG. 1B, the bottom of the second pump 800 (e.g., third wall 804A) is at least partially covered by (and optionally completely covered by) first sole component 300 (e.g., an outsole component). The second major surface 3021 of the first sole component 300 in this example further defines a third pump containing region 312P, and this third pump containing region 312P defines a third pump engaging surface 312S configured to lie immediately adjacent (and optionally into contact with) an exterior side of the third wall 804A of the second internal pump chamber 802C. If desired, as shown in the various figures, if the first major surface 302G of the first sole component 300 (e.g., an outsole component) is a ground facing surface of the sole structure 104, this first major surface 302G further may include a second protrusion 316 located opposite the third pump engaging surface 312S. This second protrusion 316 may extend outward from a bottom base surface of the ground facing surface and may help activate (e.g., compress) the second pump 800 when the sole structure 104 (e.g., the first major surface 302G of the first sole component 300) contacts the ground in use (e.g., when a wearer's foot pushes off to leave the ground during a step). Note also FIGS. 1C and 1E.

In a similar manner, the top of the second pump 800 (e.g., fourth wall 804B) is at least partially covered by (and optionally completely covered by) second sole component 600 (e.g., a midsole component). The fourth major surface 602G of this illustrated example includes a second pump containing region 612P, and this second pump containing region 612P defines a second pump engaging surface 612S configured to lie immediately adjacent (and optionally in contact with) an exterior side of the fourth wall 804B of the second internal pump chamber 802C.

As further shown by FIGS. 1B, 1D, 1F, 1G, and 1H, the second internal pump chamber 802C has an ellipsoidal and/or spheroidal shape. Also, each of the third pump engaging surface 312S (of the first sole component 300) and the second pump engaging surface 612S (of the second sole component 600) has a semi-ellipsoidal and/or semi-spheroidal shape (e.g., approximately half-ellipsoidal and/or half-spheroidal shaped). One or both of the pump engaging surfaces 312S and/or 612S may directly contact the exterior sides of pump walls 804A and/or 804B, respectively, of the second pump chamber 802C. Optionally, if desired, one or both of the pump engaging surfaces 312S and/or 612S may be fixed to the exterior sides of pump walls 804A and/or 804B, respectively, of the second pump chamber 802C (by adhesives or cements) so that the pump walls 804A and/or 804B will move (inward and outward) as the first sole component 300 and second sole component 600 move (compress and expand) with respect to one another (e.g., to compress and expand the pump chamber 802C). This "fixed" feature may be particularly useful to pull the opposite pump walls 804A/804B apart (and consequently pull new fluid (e.g., air) into the pump chamber 802C through the inlet 802I) as the first sole component 300 and the second sole component 600 return and/or re-expand to their original positions after the user's weight is lifted off the pump 800 during a step cycle.

When two pumps 500 and 800 are present in a sole structure 104, e.g., as shown in this illustrated example, the pumps may have the same or different constructions and/or the same or different sizes (e.g., volumes, dimensions, etc.). As some more specific examples, either or both of the pumps 500, 800 may be a compressible bulb type pump that is/are positioned to be activated by contact between a wearer's foot and a contact surface (e.g., the ground). In such structures, pump 500 may be structured and arranged in the sole structure 104 to be compressed when a wearer's heel contacts the ground (e.g., when landing a step) and pump 800 may be structured and arranged in the sole structure 104 to be compressed when a wearer's forefoot contacts the ground (e.g., a big toe area, such as when toeing off on a step). See FIG. 1G. The terms "ellipsoidal," "semi-ellipsoidal," "spheroidal," and "semi-spheroidal" as used herein should not be construed as requiring the surface of the noted object to follow any precise mathematical formula and/or functional shape, but rather these terms are used to refer to objects having surfaces that generally conform to the noted shapes (e.g., generally smoothly curved egg, bulbous, and/or ball shaped objects or other generally ellipsoidal, spheroidal, semi-ellipsoidal, and/or semi-spheroidal shaped objects). Also, the terms "semi-ellipsoidal" and/or "semi-spheroidal" do not require the presence of exactly one half of an ellipsoidal and/or spheroidal shape. Rather, these terms include a surface that partially surrounds, lies adjacent to, and/or contacts the pump's exterior surface, e.g., surrounding, lying adjacent to, and/or contacting at least 25% of the pump's exterior surface, and in some examples, at least 30%, at least 35%, at least 40%, or even at least 45% of the pump's exterior surface.

At least one of the pumps 500, 800 (and in this illustrated example, it is pump 800) has its outlet 502O, 802O in fluid communication with fluid filled bladder 400. As a more specific example, fluid line 522 connects the second outlet 802O of pump 800 with inlet 4021 of fluid filled bladder 400. See FIG. 1H. As shown in FIG. 1B, in this illustrated example, at least a portion of (and optionally all of) the fluid filled bladder 400 is located between the second major surface 3021 of the first sole component 300 and the fourth major surface 602G of the second sole component 600. Also, as shown in FIGS. 1B and 1G, the fluid filled bladder 400 has a medial side portion 400M and a lateral side portion 400L, and these side portions 400M, 400L are separated from another, at least in part, by one or more of the pump 500, the pump 800, and/or the first fluid line 520. Fluid may be free to flow between medial side portion 400M and lateral side portion 400L (e.g., to keep both side portions 400L and 400M at the same pressure), or fluid flow/fluid pressure may be controlled between these portions 400M, 400L (e.g., to allow the side portions 400M and 400L to have different pressures). The fluid filled bladder 400 may be a foot support bladder and/or a reservoir bladder (e.g., a bladder used to supply fluid to, capture fluid from, and/or store fluid for use by a foot support bladder).

In the illustrated example of FIGS. 1A-1G, the first sole component 300 (e.g., an outsole component) and the second sole component 600 each are formed as a one-piece construction that extends continuously to support an entire plantar surface of a wearer's foot. Other options are possible, however, without departing from some aspects of this technology. For example, if desired, the outsole component 300 could be provided as multiple component parts (e.g., such as a heel outsole component 310A and a forefoot outsole component 310B, as shown by broken lines in FIGS. 1C and 1D). In such an arrangement, protrusions 306 and 316, pump containing regions 302P and 312P, and pump engaging surfaces 302S and 312S are provided on different outsole component parts. More specifically, in such an arrangement: (a) protrusion 306, pump containing region 302P, and pump engaging surface 302S are provided on heel outsole component 310A and (b) protrusion 316, pump containing region 312P, and pump engaging surface 312S are provided on forefoot outsole component 310B. Additionally or alternatively, if desired, the midsole component 600 could be provided as multiple component parts (e.g., such as a heel midsole component 610A and a forefoot midsole component 610B, as shown by broken lines in FIG. 1F). In such an arrangement, pump containing regions 602P and 612P and pump engaging surfaces 602S and 612S are provided on different midsole component parts. More specifically, in such an arrangement: (a) pump containing region 602P and pump engaging surface 602S are provided on heel midsole component 610A and (b) pump containing region 612P and pump engaging surface 612S are provided on forefoot midsole component 610B. Separate arch based outsole and/or midsole component parts may be provided in the sole structure 104 and/or a gap may be provided in the arch area between heel based component parts and forefoot based component parts of the midsole 600 and/or the outsole 300. As another alternative, the heel based components 310A, 610A and/or the forefoot based components 310B, 610B may extend into or through the arch area and meet one another, e.g., thereby avoiding an open gap between the heel based components 310A, 610A and the forefoot based components 310B, 610B. Other multi-component part structures for midsole 600 and/or outsole 300 may be used without departing from some aspects of this technology.

Also, FIG. 1G shows the first pump 500, the second pump 800, the fluid filled bladder 400 (including side components 400M and 400L), and first fluid line 520 formed as a unitary, one-piece construction. Such a bladder can be formed by thermoforming techniques (e.g., from one or more sheets of thermoplastic material that is/are selectively secured together (e.g., via welding techniques) and/or include internal structures or components to form the desired sizes and shapes). Such bladders 400 may be formed in manners that are known and used in the art. Alternatively, if desired, these items in bladder 400 may be formed as two or more separate parts without departing from some aspects of this technology. As some more specific examples: (a) the bladder portion(s) 400/400M/400L could be formed separate from one or both pumps 500/800; (b) bladder portions 400M and 400L could be formed separate from one another (with or without the pump(s) 500/800 and/or fluid line 520); (c) the fluid line 520 could be a separate part from one or both pumps 500, 800 and/or from the fluid filled bladder 400 or bladder portions 400M/400L; etc.

FIGS. 1B and 1H further show that this example sole structure 104 includes a foot support bladder 700 for supporting at least a portion of a plantar surface of a wearer's foot (and optionally all of the plantar surface of a wearer's foot). The foot support bladder 700 can be formed by thermoforming techniques (e.g., from one or more sheets of thermoplastic material that are selectively secured together (e.g., by welding techniques) and/or include internal structures or components to form the desired sizes and shapes). Such bladders 700 may be formed in manners that are known and used in the art. The foot support bladder 700 may be in fluid communication with the fluid filled bladder 400 (e.g., a reservoir bladder), for example, via a fluid transfer control system 900 (e.g., a programmable control valve), examples of which will be described in more detail below. In some examples of this technology, e.g., as shown in FIG. 1B, at least a portion of the foot support bladder 700 is located adjacent (and optionally in contact with and/or fixed to) the third major surface 602I of the second sole component 600 (e.g., a midsole component and/or foot support plate). If desired, the foot support bladder 700 could be omitted and the other bladder 400 could be used for foot support purposes.

Figure 2A:
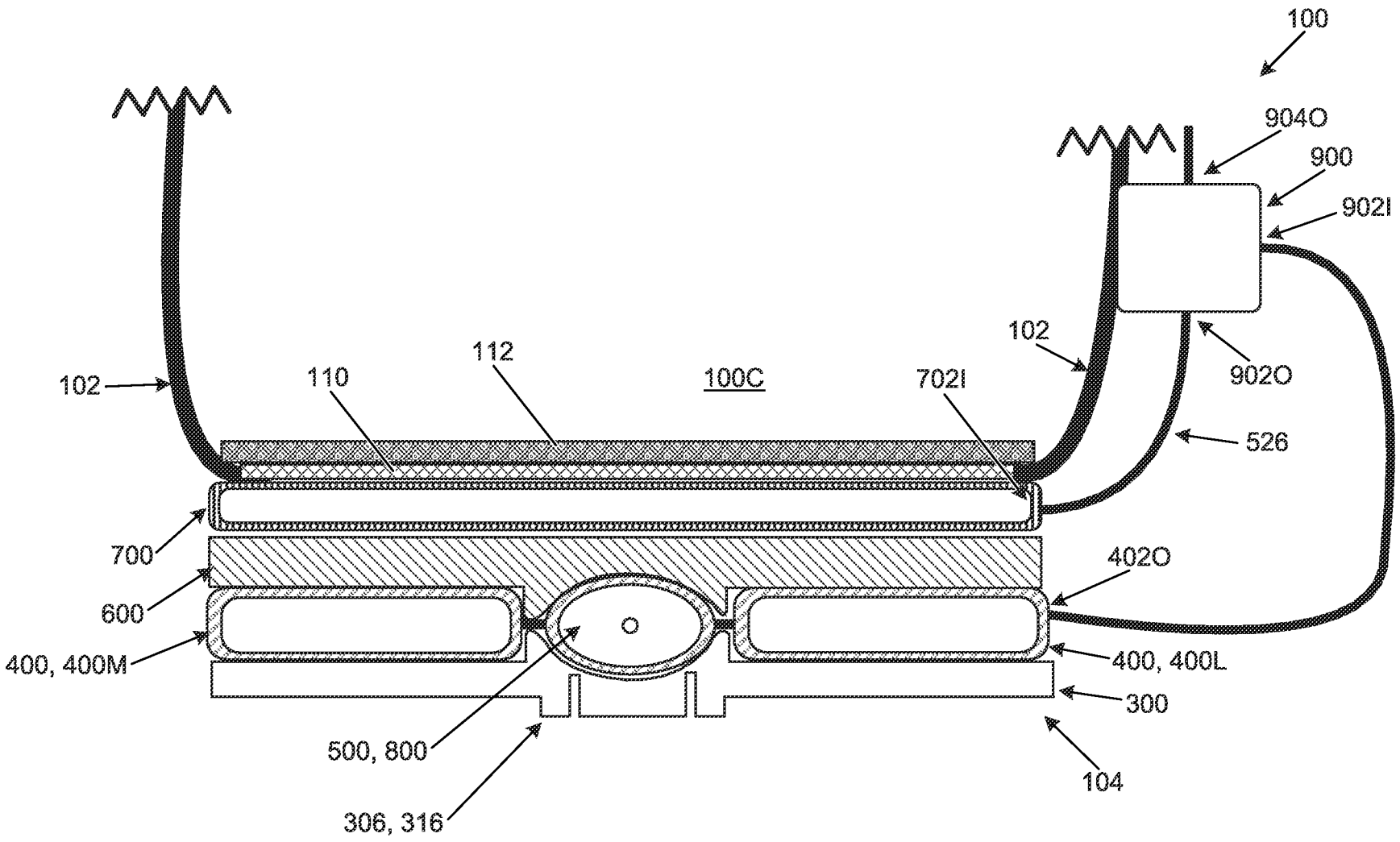
FIGS. 2A-2C provide various views illustrating features of fluid transfer systems and articles of footwear in accordance with some examples of this technology.
Figure 2B:
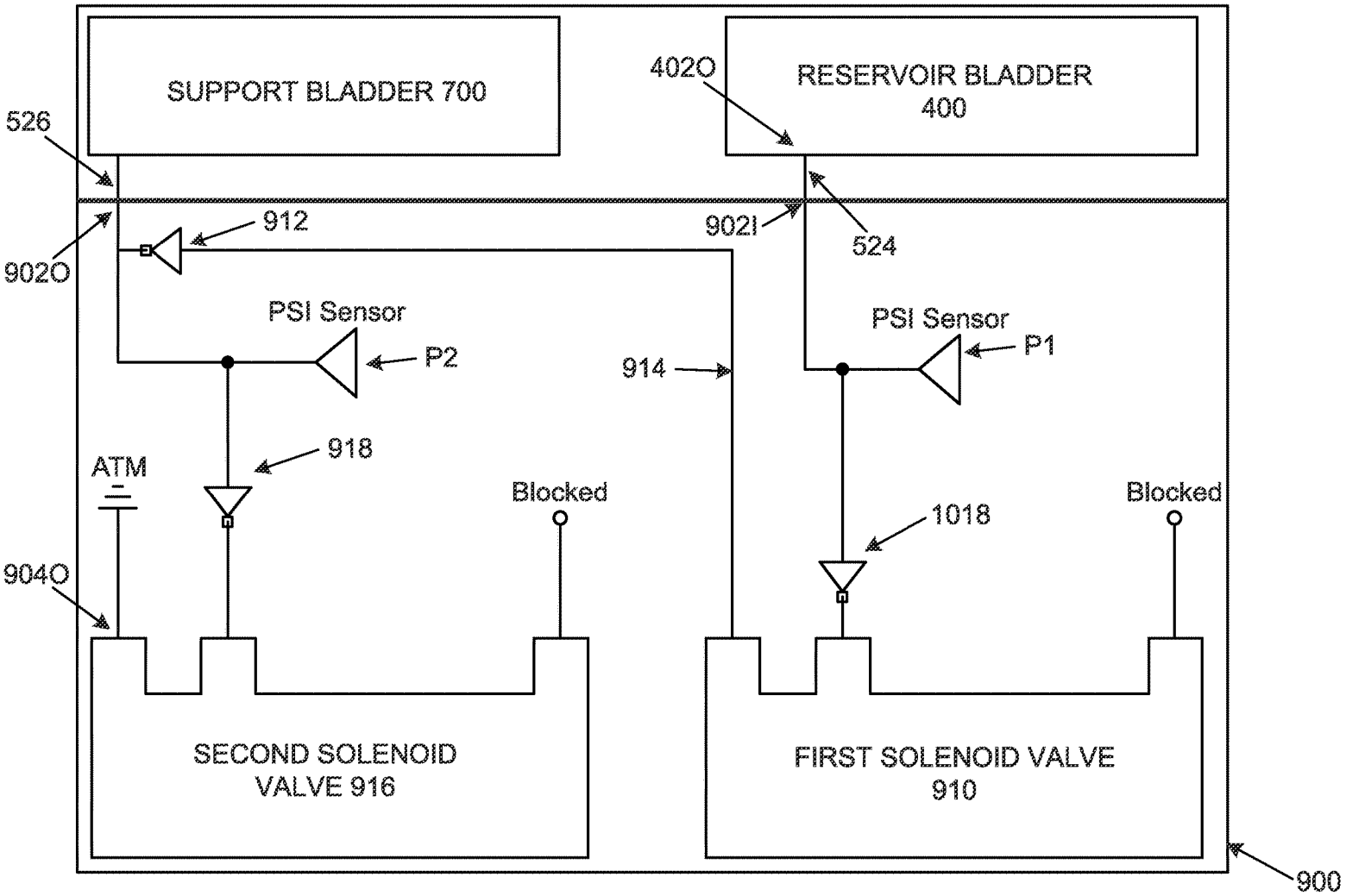
Figure 2C:
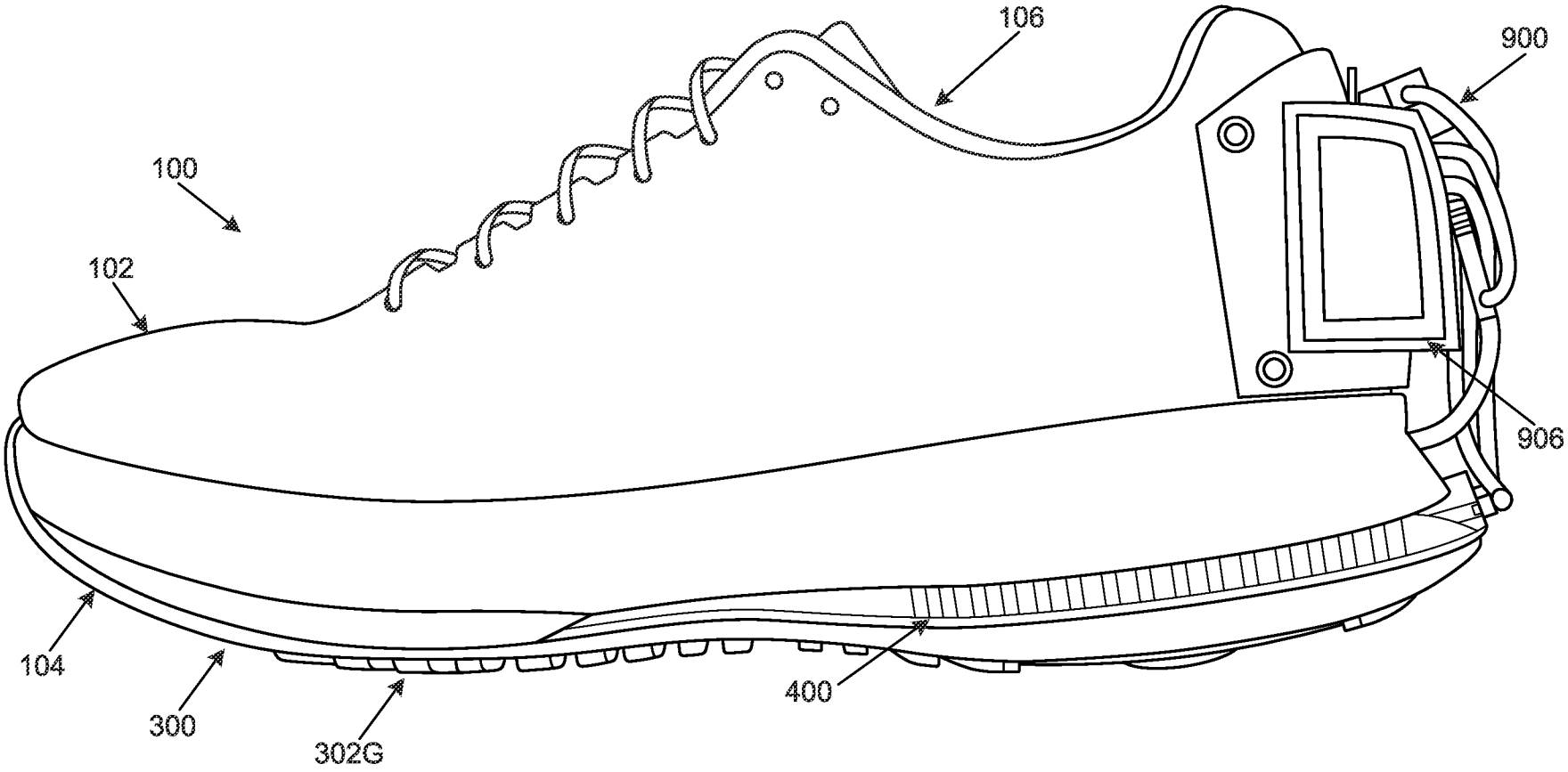

Aspects of fluid transfer systems 1000, e.g., for articles of footwear or other foot-receiving devices, in accordance with some examples of this technology will be described, e.g., in conjunction with FIGS. 1H-2C. FIG. 1H provides a schematic view of the fluid transfer system 1000 and example overall components. FIG. 2A is a transverse, medial side-to-lateral side, vertical cross sectional view of the shoe 100 components with some features of the fluid transfer system 1000 highlighted. FIG. 2B provides a schematic view of an example fluid transfer control system 900 and components thereof. FIGS. 2A and 2C show the fluid transfer control system 900 engaged with the article of footwear 100 (e.g., engaged with one or more components of the upper 102 and/or the sole structure 104, e.g., by one or more of adhesives or cements; mechanical connectors; sewn seams; etc.). As compared to FIG. 1A, FIG. 2C shows that a cover member 906 may be provided, e.g., to partially or fully cover the electronics and/or other structures of the fluid transfer control system 900 and fluid transfer system 1000.

This example fluid transfer system 1000 includes a first pump 500 having a first pump chamber 502C, a first inlet 502I, and a first outlet 502O. A fluid transfer line 510 connects to the first inlet 502I and connects the first pump 500 with an external fluid source 1010 (such as an ambient air source). This fluid transfer line 510 moves fluid from the external fluid source 1010 into the first pump chamber 502C through the first inlet 502I. A valve 1012 (e.g., a check valve or one-way valve) may be provided in line 510, e.g., to prevent fluid from flowing out of the first pump chamber 502C and back to the external fluid source 1010 through fluid transfer line 510. In this manner, when the first pump 500 is activated (e.g., the bulb pump is compressed or squeezed), fluid is forced out of the first pump chamber 502C via first outlet 502O.

This example fluid transfer system 1000 includes a second pump 800 that has a second pump chamber 802C, a second inlet 802I, and a second outlet 802O. Another fluid transfer line 520 connects the first outlet 502O of the first pump 500 with the second inlet 802I of the second pump 800. This fluid transfer line 520 moves fluid discharged from the first outlet 502O into the second pump chamber 802C through the second inlet 802I. A valve 1014 (e.g., a check valve or one-way valve) may be provided in line 520, e.g., to prevent fluid from flowing out of the second pump chamber 802C and back into the fluid transfer line 520 and/or the first pump chamber 502C. In this manner, when the second pump 800 is activated (e.g., the bulb pump is compressed or squeezed), fluid is forced out of the second pump chamber 802C via second outlet 802O.

Another fluid transfer line 522 connects to the second outlet 802O of the second pump 800 and receives fluid discharged from the second pump chamber 802C. A valve 1016 (e.g., a check valve or one-way valve) may be provided in fluid transfer line 522, e.g., to prevent fluid from flowing back into the second pump chamber 802C via fluid transfer line 522 once it has been pumped out. The other end of fluid transfer line 522 connects to (or is otherwise in fluid communication with) fluid-filled bladder 400. This example fluid-filled bladder 400 is a reservoir bladder (e.g., a bladder that stores fluid for transfer into a foot support bladder). Additionally or alternatively, if desired, fluid-filled bladder 400 may itself be a foot support bladder or a part of a foot support bladder system, e.g., for an article of footwear or other foot-receiving device. Additionally or alternatively, at least some part of the bladder 400 may be engaged with and/or formed as at least a part of the footwear upper 102.

In at least some example fluid transfer systems 1000 in accordance with this technology, the fluid-filled bladder 400 may function as a fluid source or reservoir for a foot support bladder 700. A fluid transfer control system 900 may be provided to control flow of fluid between the fluid-filled bladder 400 and the foot support bladder 700, e.g., to enable control and change of pressure in the foot support bladder 700. Fluid transfer line 524 moves fluid from the fluid-filled bladder 400, through outlet 402O, into the fluid transfer control system 900 (via inlet 902I). Optionally, if necessary or desired, a valve 1018 (e.g., a check valve or one-way valve) may be provided in fluid transfer line 524, e.g., to prevent fluid from flowing back into the fluid-filled bladder 400 via fluid transfer line 524 once it has been released through outlet 402O.

The fluid transfer control system 900 may include a programmable controller and/or one or more user controlled and/or electronically controlled valves (e.g., solenoid valves, check valves, one-way valves, etc.) that can be used and controlled to move and control movement of fluid from the fluid-filled bladder 400 to the foot support bladder 700; from the foot support bladder 700 to the bladder 400; and/or from either or both of bladders 400, 700 and/or from control system 900 to be released or vented, e.g., to the ambient environment (optionally under control of a valve 1020). Fluid transfer line 526 connects one outlet 902O of fluid transfer control system 900 to an inlet port 702I of the foot support bladder 700. Another outlet 904O of the fluid transfer control system 900 releases fluid from the system 1000, e.g., vents fluid to the ambient environment and/or returns fluid back to bladder 400. Optionally, if desired, the foot support bladder 700 may include a check valve 706 (or other one-way valve) set to an appropriate crack pressure to avoid over inflation of the foot support bladder 700.

Any desired type of fluid transfer control system 900 structure and components could be used without departing from this technology, including programmable and/or electronically controllable valves, manually controllable valves, systems that include one or more pressure sensors, etc. A schematic of one example fluid transfer control system 900 is shown in FIG. 2B. In this illustrated example, a pressure sensor P1 is provided, e.g., in fluid transfer line 524 from the reservoir bladder 400 (or in a line in communication with fluid transfer line 524). Fluid from the reservoir bladder 400 is introduced into a first solenoid valve 910 (or other controllable valve). When opened, fluid from line 524 flows through the solenoid valve 910 to valve 912 via fluid transfer line 914. Fluid transfer line 914 transfers fluid through valve 912 into fluid transfer line 526, which is in fluid communication with foot support bladder 700 and second solenoid valve 916. Flow through fluid transfer line 526 is controlled based on pressure readings from pressure sensor P2 (which is within fluid transfer line 526 or in a line in communication with fluid transfer line 526) and a desired pressure setting for foot support bladder 700. For example, a user may set a desired cushioning level for the foot support bladder 700 (e.g., via an electronic interface, such as a cellular telephone application program, a controller on the shoe, etc.). If the pressure sensor P2 senses that the pressure in fluid transfer line 526 (and thus pressure in the foot support bladder 700) is below that desired cushioning level, second solenoid valve 916 may be closed and/or the crack pressure of valve 918 may be appropriately set so that fluid from reservoir bladder 400 flows through fluid transfer line 524, through first solenoid valve 910, through fluid transfer line 914, through valve 912, through outlet 902O, and into foot support bladder 700. Fluid can flow in this manner (e.g., pumped by pumps 500, 800) until the desired pressure level is reached (as measured by pressure sensor P2) in the foot support bladder 700. The second solenoid valve 916 can further be controlled and/or the crack pressure of valve 918 can be set such that further increases in pressure in line 526 (e.g., above the desired pressure setting for foot support bladder 700) may pass through valve 918 and second solenoid valve 916 and be released, e.g., vented, e.g., to the ambient environment (ATM) via outlet 904O and/or returned to the bladder 400. In this manner, fluid can continue to be pumped through the overall foot support system 1000, e.g., from the ambient environment 1010, through pump 500, through pump 800, through fluid-filled bladder 400 (e.g., a reservoir bladder), and into fluid transfer control system 900, from which it is either introduced into the foot support bladder 700 (via fluid transfer line 526), released, e.g., vented back into the ambient environment (through valve 918 and second solenoid valve 916, depending on the pressure level in foot support bladder 700 and/or the desired pressure setting for foot support bladder 700), and/or returned to bladder 400.

As further shown in the figures (e.g., FIG. 1G), aspects of the present technology further relate to a foot support system (e.g., sole structure 104 and fluid flow control system 1000) that includes:

(a) a fluid-filled bladder or reservoir bladder 400 having an interior volume 4001 for containing fluid, a first longitudinal area (e.g., heel area 400H), and a second longitudinal area 400F (e.g., a forefoot area) located forward of the first longitudinal area 400H;

(b) a first pump 500 including a first pump chamber 502C, a first inlet 502I, and a first outlet 502O, wherein the first pump 500 is located at or adjacent the first longitudinal area 400H of the fluid-filled bladder 400;

(c) a first fluid transfer line 510 connected to the first inlet 5201 and connecting the first pump 500 with an external fluid source 1010, wherein the first fluid transfer line 510 moves fluid from the external fluid source 1010 into the first pump chamber 502C via the first inlet 502I;

(d) a second pump 800 including a second pump chamber 802C, a second inlet 802I, and a second outlet 802O, wherein the second pump 800 is located at or adjacent the second longitudinal area 400F of the fluid-filled bladder 400;

(e) a second fluid transfer line 520 connected to the second inlet 802I and admitting fluid discharged from the first outlet 502O into the second pump chamber 802C via the second inlet 802I; and (f) a third fluid transfer line 522 connected to the second outlet 802O and receiving fluid discharged from the second pump chamber 802C, wherein the fluid-filled bladder 400 is in fluid communication with the second pump 802 at least in part via the third fluid transfer line 522.

The fluid filled bladder 400 further may include one or more of: (a) a lateral side portion 400L located on a lateral side of the first pump 500, (b) a medial side portion 400M located on a medial side of the first pump 500, (c) a lateral side portion 400L located on a lateral side of the second pump 800, (d) a medial side portion 400M located on a medial side of the second pump 800, (e) a lateral side portion 400L located on a lateral side of second fluid transfer line 520, and/or (f) a medial side portion 400M located on a medial side of second fluid transfer line 520.

As also described above, this foot support system further may include a second fluid-filled bladder 700, e.g., as a foot support bladder. When present, a fluid transfer control system 900, e.g., of the various types described above, connects the fluid-filled bladder 400 with the second fluid-filled bladder 700. One or both of the fluid-filled bladder 400 and/or the second fluid-filled bladder 700 may be engaged with a sole component (e.g., a midsole component 600, an outsole component 300, both etc.) and/or with a footwear upper 102. Additionally or alternatively, one or both of the fluid-filled bladder 400 and/or the second fluid-filled bladder 700 may be structured, oriented, and configured to form a plantar support surface for all or some portion (e.g., a heel portion, a forefoot portion, etc.) of a plantar surface of a wearer's foot.

In use, as evident from the figures, each of the first pump 500 and the second pump 800 is structured (e.g., as a bulb pump), oriented (e.g., beneath a wearer's foot), and configured to be compressed in response to force applied by a wearer's foot against a surface. As some more specific features: (a) the first pump chamber 502C is structured, oriented, and configured to be compressed in response to downward force applied by a wearer's heel (e.g., when landing a step) and/or (b) the second pump chamber 802C is structured, oriented, and configured to be compressed in response to downward force applied by a wearer's forefoot (e.g., one or more toes, e.g., when leaving the ground during "toe-off" of a step). The inclusion of two pumps in series (e.g., pump 500 supplying fluid directly to pump 800) allows the initial pump up of the fluid filled bladder 400 and/or the foot support bladder 700 to be achieved more quickly, as fluid from the first pump 500 quickly supplies the second pump 800, which then transfers to the bladders 400/700.

Figure 3:
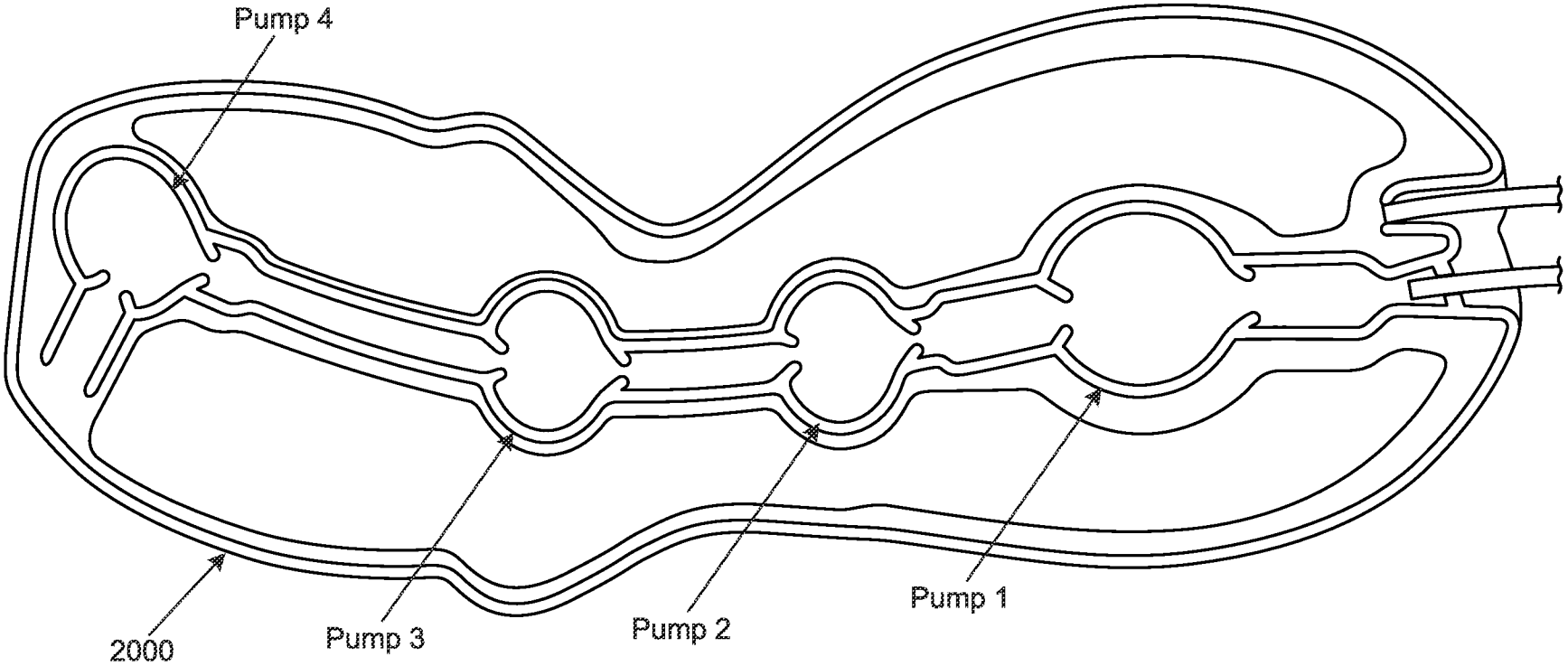
FIG. 3 illustrates positions of pumps in another example foot support system of this technology.

While the above described examples of this technology show two pumps arranged in series, one skilled in the art, given benefit of this disclosure, will recognize that three or even more pumps (e.g., compressible bulb pumps) could be arranged in series, if desired in a single sole structure. In at least some examples of this aspect of the technology, as shown in FIG. 3, a series arrangement of pumps could be spaced, in order, from the rear heel area of the sole structure component 2000, through the midfoot area, and to the forefoot area of the sole structure component 2000. The pumps could be arranged in a series sequence so as to be activated in succession (from back-to-front) as the wearer's weight transfers during a step cycle, e.g., from a lateral heel area (where one typically lands a step), through the midfoot area, and finally at the medial toe area (for toe-off at the end of the step). In the example of FIG. 3, the pumps would be activated in order as Pump 1, Pump 2, Pump 3, and Pump 4 as a typical step progresses. Any desired number of pumps could be provided in this series sequence. Further, each of the pumps may have any of the structures and/or options for the structures described above in conjunction with FIGS. 1A-2C, including any of the structures and/or options for the other components of the sole structure (e.g., the pump containing regions and/or pump engaging surfaces of the outsole 300 and/or the midsole 600; protrusions on the outsole 300; etc.).

Figure 4:
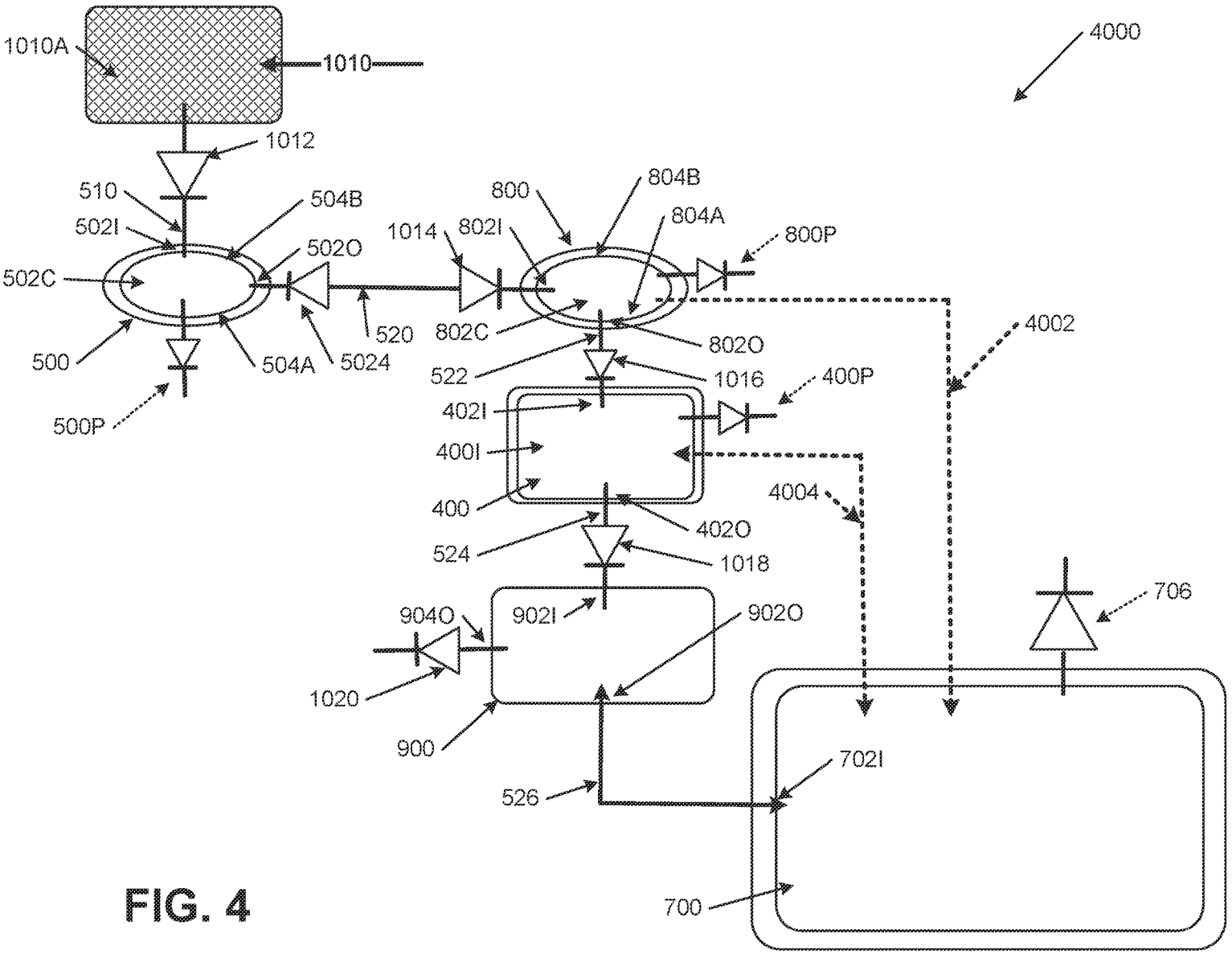
FIG. 4 includes a schematic diagram of fluid transfer systems and foot support systems provided to highlight additional and/or alternative features of aspects of this technology.

FIG. 4 includes a schematic diagram of fluid transfer systems and/or foot support systems 4000 in accordance with some additional examples of this technology. FIG. 4 is similar to FIG. 1H described above, and when the same reference number is used in FIG. 4 as used in FIG. 1H (or the other figures), the same or similar components are intended. Thus, a complete and/or detailed description of that component may be omitted from the discussion of FIG. 4.

Like the system 1000 of FIG. 1H, the system 4000 of FIG. 4 includes a two-stage pump (pump 500 in series with pump 800) providing fluid to reservoir 400, which in turn supplies fluid to fluid transfer control system 900, which in turn supplies fluid to foot support bladder 700. Alternatively, if desired, the system 4000 of FIG. 4 may use a single pump rather than this two-stage pump, at least in some examples of this technology. One difference between the system 4000 of FIG. 4 and that shown in FIG. 1H includes the filter 1010A to filter incoming fluid from external fluid source 1010, which may be ambient atmosphere. The filter 1010A helps prevent water, debris, mud, dirt, particulate matter, etc., from entering the system 4000. Such a filter 1010A optionally may be removable, cleanable, and/or replaceable, if desired. Also, any of the examples of this technology described above in conjunction with FIGS. 1A to 3 may include a filter of this type.

FIG. 4 further shows additional features that may be included in such systems 4000 to handle fluid flow when the foot support bladder 700 and the reservoir 400 contain fluid at a desired pressure level and/or at steady state. As described above, aspects of this technology include use of foot-activated pumps 500, 800 to inflate and adjust fluid pressure in both the reservoir 400 and the foot support bladder 700. In use, however, unless they are de-activated in some manner, foot-activated pumps 500, 800 will continue to move fluid into the system 4000 during each step as the user walks, runs, and/or undertakes other activities. This fluid has to move through and/or out of the system 4000 in some manner, e.g., to prevent over-inflation of bladder 700 or reservoir 400 (and potentially rupturing parts, including tubing or bladders included in the system 4000). The system 1000 of FIG. 1H included valves 1020 and/or 706 that were capable of discharging fluid from that system (e.g., to the ambient environment) as the user continues to step down on pump(s) 500, 800. Thus, once at a desired pressure in each part of the system 1000, the system 1000 of FIG. 1H allows fluid to escape (e.g., through valve(s) 1020 and/or 706) at the same general rate at which it enters.

Additional or alternative pressure release systems are possible. For example, as shown in FIG. 4, either or both of pumps 500, 800 may include a valve (e.g., a check valve) to release incoming fluid as it is pumped into the system 4000 and before it goes to the reservoir 400, fluid transfer control system 900, and/or foot support bladder 700. As shown pump 500 may include release valve 500P and/or pump 800 may include release valve 800P. The crack pressure(s) of valve(s) 500P and/or 800P may be set (or these valves 500P, 800P may be otherwise controlled, e.g., manually, by an electronic control that is part of fluid transfer control system 900, etc.) to release incoming fluid to the external environment—on a step-by-step basis, if necessary—once reservoir 400 and/or foot support bladder 700 is/are at a desired and/or set pressure level.

Additionally or alternatively, if desired, a release valve 400P (e.g., a check valve, a manually or electronically controlled valve, etc.) could be included in fluid communication with the interior 4001 of the reservoir 400. Using valve 400P, the system 4000 may release incoming fluid as it is pumped into the system 4000 before it goes to the fluid transfer control system 900 and/or foot support bladder 700. The crack pressure(s) of valve 400P may be set (or it may be otherwise controlled, e.g., manually, by an electronic control that is part of fluid transfer control system 900, etc.) to release incoming fluid to the external environment—on a step-by-step basis, if necessary—once reservoir 400 and/or foot support bladder 700 is/are at a desired and/or set pressure level.

FIG. 4 shows other additional or alternative features that may be included in systems 4000 in accordance with at least some examples of this technology. In the system 1000 of FIG. 1H, fluid flows from the reservoir 400, through fluid transfer control system 900, and from there, when needed, to the foot support bladder 700. Other and/or additional structures are possible. As shown in FIG. 4, if desired, a fluid line 4002 may run directly from pump 800 (and/or even from pump 500) to the foot support bladder 700. While not shown in the example of FIG. 4, this fluid line 4002 may be equipped with one or more valves, e.g., check valves, and/or other structures to prevent fluid from flowing from bladder 700 into pump 800 (or 500), to control the pressure at which fluid line 4002 is opened (to allow fluid to be pumped directly into foot support bladder, 700), etc. Fluid line 4002 may be useful, for example, in situations when foot support bladder 700 is at very low pressure, when it is desired to inflate quickly, when large pressure increases are desired, etc.

As an additional or alternative feature, the system 4000 of FIG. 4 may include a fluid line 4004 running directly from reservoir 400 to the foot support bladder 700. This fluid line 4004 also may be equipped with one or more valves, e.g., check valves or other structures, to prevent fluid from flowing from bladder 700 into reservoir 400 and/or to control the conditions under which fluid may be allowed to move between bladder 700 and reservoir 400 (in either direction). Fluid line 4004 may be particularly useful, for example, in situations when foot support bladder 700 is at very low pressure, when one wants to inflate foot support bladder 700 quickly, when large and/or quick pressure changes (increased or decreased in bladder 700) are desired, etc.

Thus, fluid transfer systems and foot support systems 4000 in accordance with at least some examples of this technology may selectively move fluid through any one or more of the following paths and/or between any of the following components: (a) from a pump (e.g., pump 500, pump 800) to the external (e.g., ambient) environment (e.g., via valve 500P and/or valve 800P); (b) from a pump (e.g., pump 500, pump 800) to a reservoir 400 (e.g., fluid line 522); (c) from a reservoir 400 to a foot support bladder 700 (e.g., directly via fluid line 4004 or through a fluid transfer control system 900); (d) from a foot support bladder 700 to the external (e.g., ambient) environment (e.g., via valve 706); (e) from a pump (e.g., pump 500, pump 800) to a foot support bladder (e.g., fluid line 4002); and/or (f) from the reservoir 400 to the external (e.g., ambient) environment (e.g., via valve 400P). These same six operational states also may be accomplished in the system 1000 of FIG. 1H, e.g., by moving fluid from its starting location (e.g., pump 500, 800, reservoir 400, or bladder 700) to fluid transfer control system 900 and from there to its desired destination (e.g., ambient environment, reservoir 400, or bladder 700). In these manners, fluid transfer control system 900 operates as a central hub for receiving incoming fluid and distributing it to desired locations.

Figure 5:
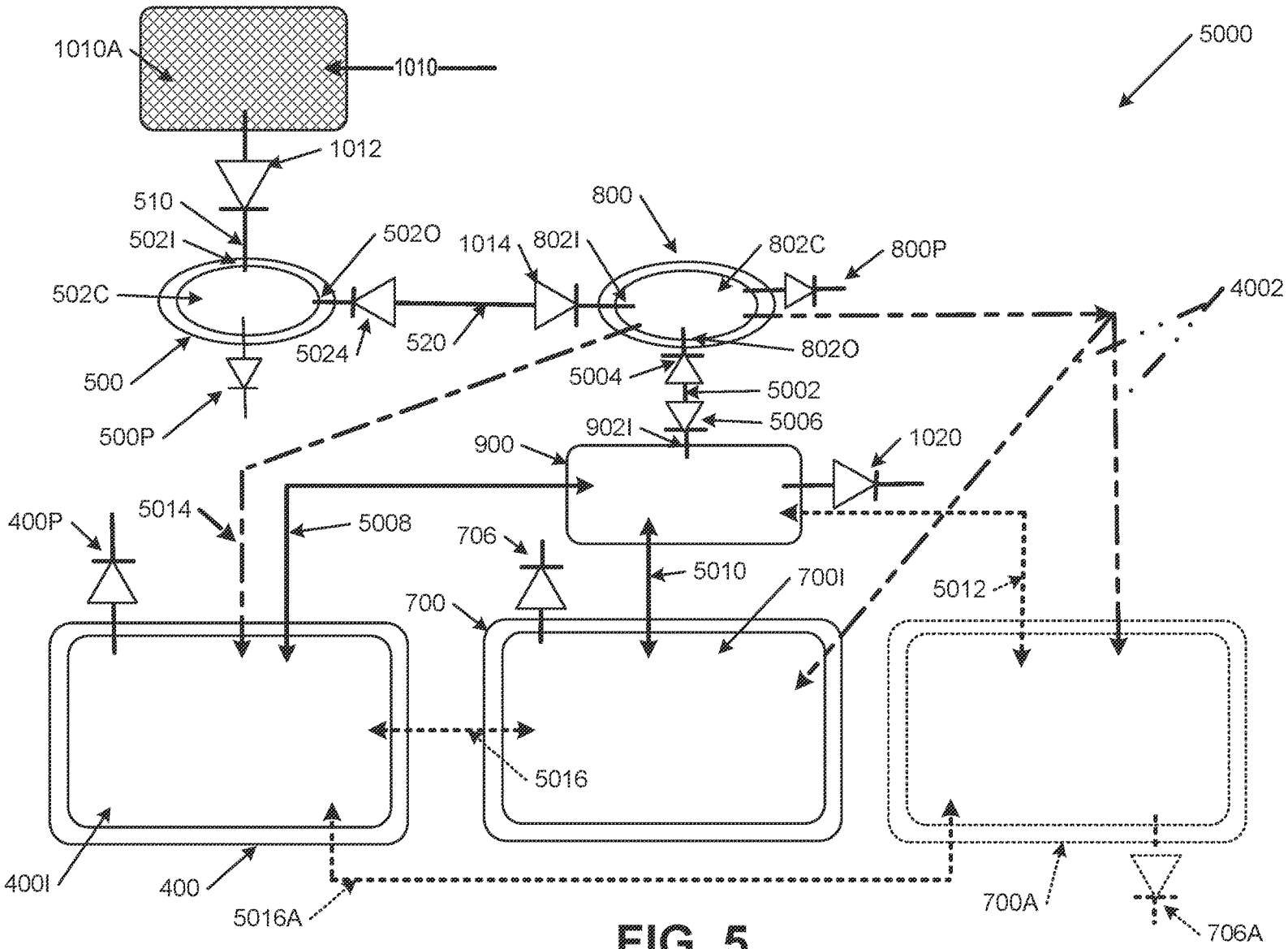
FIG. 5 includes a schematic diagram of fluid transfer systems and foot support systems provided to highlight still additional and/or alternative features of aspects of this technology.

FIG. 5 provides a schematic diagram of another fluid transfer system and/or foot support system 5000 in accordance with some examples of this technology. FIG. 5 is similar to FIGS. 1H and 4 described above, and when the same reference number is used in FIG. 5 as used in FIGS. 1H and/or 4 (or the other figures), the same or similar components are intended. Thus, a complete and/or detailed description of that component may be omitted from the discussion of FIG. 5.

In the system 5000 of FIG. 5, however, the pump 800 supplies fluid directly to a fluid transfer control system 900 (via fluid line 5002) rather than directly to the reservoir 400 as shown for systems 1000, 4000. Fluid transfer control system 900, in turn, selectively distributes fluid to and/or receives fluid from, as needed, reservoir 400 (via fluid line 5008) and/or foot support bladder 700 (via fluid line 5010). Fluid line 5002 of this example further includes check valve 5004 to prevent/control undesired fluid flow from line 5002 back into pump 800 and valve 5006 to prevent/control undesired fluid flow from fluid transfer control system 900 back into fluid line 5002. Fluid line(s) 5008 and/or 5010 may contain valving and/or other structures to enable selective and/or automated control of fluid flow through those lines, e.g., to establish and maintain desired pressure levels within reservoir 400 and/or foot support bladder 700, respectively. In this system 5000, fluid transfer control system 900 may function as a central hub for receiving and distributing fluid.

FIG. 5 shows some additional or alternative potential features that may be included in system 5000 in accordance with some examples of this technology. For example, while one foot support bladder 700 is illustrated in the examples above, the system 5000 of FIG. 5 illustrates a second foot support bladder 700A in fluid communication with fluid transfer control system 900 via fluid line 5012. Foot support system 5000 (as well as any of the other foot support systems (e.g., 1000, 4000) described above) may include any desired number of foot support bladders, including one or more, between 1 and 12, between 1 and 8, between 1 and 6, between 1 and 4, etc. When present, the additional foot support bladder(s) 700A may include any of the structures and/or features of the bladders 700 described above, any of the fluid line connections (e.g., including release valve 706A), etc., without departing from this technology. When multiple bladders 700, 700A are present, they may be in fluid communication with one another, may be isolated from one another, and/or may be selectively placed in fluid communication with one another (e.g., by opening and closing one or more valves and/or fluid lines).

The system 5000 of FIG. 5 (as well as system 4000 of FIG. 4) further may include a check valve 5024 in fluid line 520 to prevent fluid from moving from the pump chamber 502C into fluid line 520 under some conditions. For example, valve 5024 may prevent fluid from moving into line 520 under low pump 500 pumping pressure conditions (e.g., when a user taps his/her foot, when light pressure is applied to pump 500 while sitting, etc.). In this manner, fluid is moved from pump chamber 502C into line 520 only when a threshold foot-activated pressure condition is reached when the pump chamber 502 is compressed.

Valves 1014 and 5024 also may help maintain line 520 in a pressurized condition between pump 500 activations (e.g., when a user is sitting, when standing still, when the shoes are not being worn, etc.).

The system 5000 of FIG. 5 may include other additional or alternative features, e.g., such as those shown in broken lines and dot-dash lines in FIG. 5. As shown, if desired, a fluid line 4002 may run directly from pump 800 (and/or even from pump 500) to the foot support bladder 700 (and, when present, directly to any one or more additional foot support bladders 700A). While not shown in FIG. 5, fluid line(s) 4002 may be equipped with one or more valves, e.g., check valves, to prevent fluid from flowing from bladder 700 into pump 800 (or 500), to control the pressure at which fluid line 4002 is opened, etc. Fluid line 4002 may be useful, for example, in situations when foot support bladder 700 (and/or bladder(s) 700A) is at very low pressure, when it is desired to inflate quickly, when large pressure increases are desired, etc.

As an additional or alternative feature, the system 5000 of FIG. 5 may include a fluid line 5014 running directly from pump 800 (or pump 500) to the reservoir 400. This fluid line 5014 also may be equipped with one or more valves, e.g., check valves, to prevent fluid from flowing from reservoir 400 into pump 800 (or 500). Fluid line 5014 may be useful, for example, in situations when reservoir 400 is at very low pressure, when one wants to inflate reservoir 400 quickly, when large pressure changes (increased or decreased in reservoir 400) are desired, etc.

As further alternatives and/or additional features, fluid reservoir 400 may be in direct fluid communication with foot support bladder 700 (and/or, when present, one or more additional foot support bladders 700A). FIG. 5 shows fluid lines 5016 and 5016A for these direct connection purposes, and if desired, fluid may flow in either direction within these lines 5016, 5016A (into and out of reservoir 400 and/or into and out of bladder(s) 700, 700A). Fluid line(s) 5016 (5016A, when present) also may be equipped with one or more valves, e.g., check valves, to prevent fluid from flowing from bladder 700 (and/or bladder 700A) into reservoir 400 and/or to control the conditions under which fluid may be allowed to move from bladder 700 (and/or bladder 700A) into reservoir 400. Fluid line(s) 5016 (5016A) may be useful, for example, in situations when foot support bladder(s) 700 (700A) is at very low pressure, when one wants to inflate foot support bladder(s) 700 (700A) quickly, when large pressure changes (increased or decreased in bladder(s) 700 (700A) are desired, etc. If desired, in the system 5000 of FIG. 5, one or more of the additional over-pressure release valves 500P, 800P, 400P, 706, 706A still may be provided (e.g., as extra protection against over-inflation of the systPPem 5000) or one or more may be omitted.

Like system 4000, fluid transfer systems and foot support systems 5000 in accordance with at least some examples of this aspect of the technology shown in FIG. 5 may selectively move fluid through any one or more of the following paths and/or between any one or more of the following components: (a) from a pump (e.g., pump 500, pump 800) to the external (e.g., ambient) environment (e.g., via valve 500P and/or valve 800P); (b) from a pump (e.g., pump 500, pump 800) to a reservoir 400 (e.g., fluid line 5014); (c) from a reservoir 400 to a foot support bladder 700 (e.g., via fluid line 5016, 5016A); (d) from a foot support bladder 700, 700A to the external (e.g., ambient) environment (e.g., via valve 706, 706A); (e) from a pump (e.g., pump 500, pump 800) to a foot support bladder (e.g., fluid line 4002); and/or (f) from the reservoir 400 to the external (e.g., ambient) environment (e.g., via valve 400P).

Figure 6:
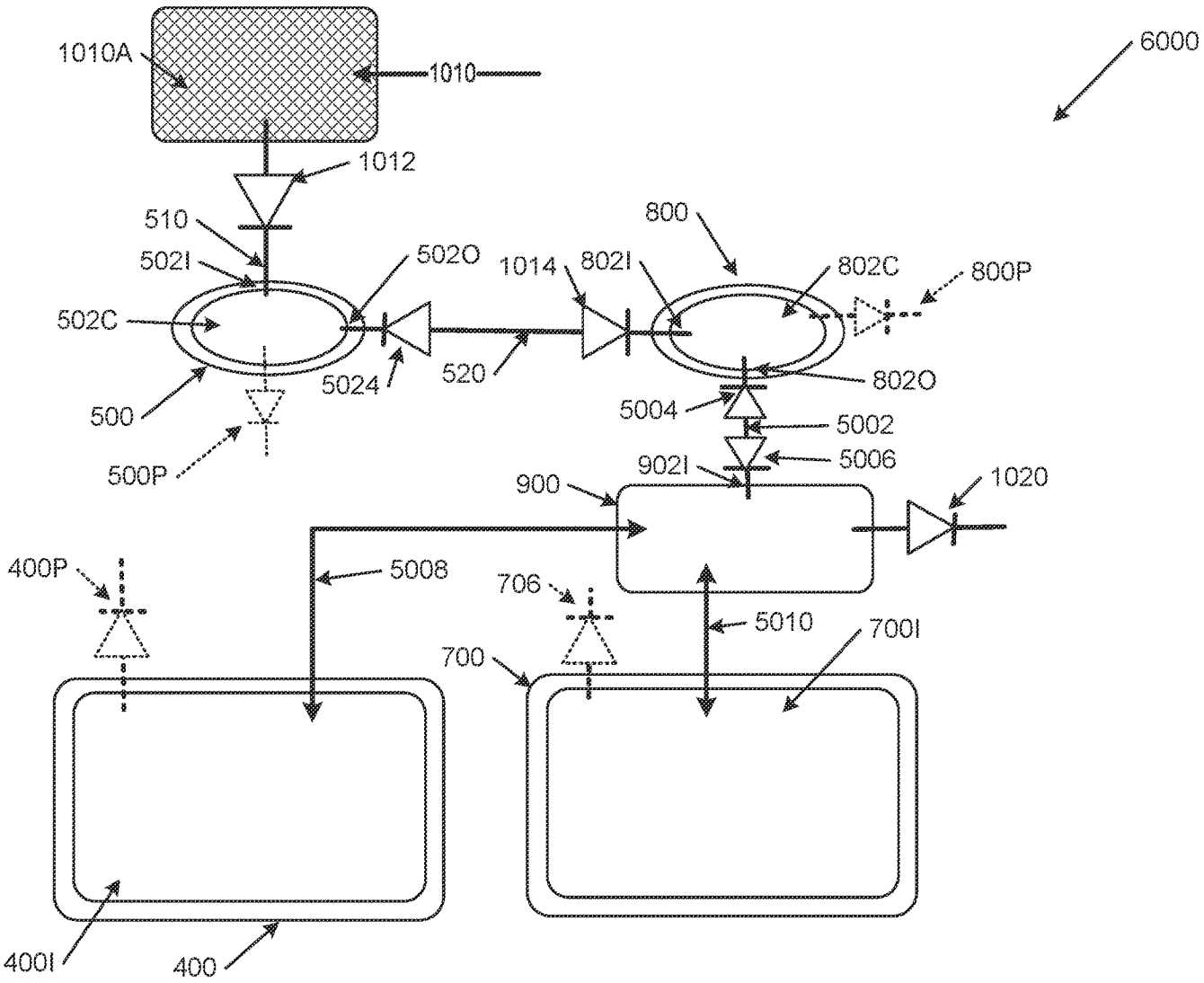
FIG. 6 includes a schematic diagram of one more specific configuration of the fluid transfer systems and foot support systems shown in FIG. 5.

Alternatively, fluid transfer control system 900 could operate to place the system into the six different operating states described above without one or more (or any) of fluid lines 4002, fluid lines 5014, fluid lines 5016, 5016A, valve 500P, valve 800P, valve 400P, valve 706, and/or valve 706A. FIG. 6 shows one example of such a system 6000. In this system 6000, the fluid transfer control system 900 acts as a central hub for receiving and distributing fluid. In this example system 6000, the fluid transfer control system 900 includes a housing, manifold, or body member having (at least) four physical connections or ports, namely: (a) a connection or port connecting from the pump 800 (which optionally may be part of a two-stage pump system including pumps 500, 800, but a single pump 800 also may be used in some examples of this system 6000) via fluid line 5002; (b) a connection or port connecting to reservoir 400 via fluid line 5008; (c) a connection or port connecting to foot support bladder 700 via fluid line 5010; and (d) a connection or port connecting to the external (ambient) environment via valve 1020. The system 6000 of FIG. 6 provides at least six different operating states as follows:

(a) moving fluid from a pump (e.g., pump 500, pump 800) to the external (e.g., ambient) environment by moving fluid from pump 800 into fluid transfer control system 900 and out through valve 1020 (fluid lines 5008 and 5010 are closed during this operational state)—this operational state may be used, e.g., on a step-by-step basis, when reservoir 400 and bladder 700 are at desired operating pressures and the pump(s) 500, 800 continue bringing fluid into the system 6000;

(b) moving fluid from a pump (e.g., pump 500, pump 800) to a reservoir 400 by moving fluid from pump 800, into fluid transfer control system 900, and from there into reservoir 400 (fluid line 5010 and valve 1020 are closed during this operational state)—this operational state increases pressure in reservoir 400;

(c) moving fluid from a reservoir 400 to a foot support bladder 700 by moving fluid from reservoir 400 to fluid transfer control system 900 via line 5008, and from there into bladder 700 via line 5010 (valve 1020 is closed during this operational state)—this operational state adjusts (increases) pressure in bladder 700;

(d) moving fluid from a foot support bladder 700 to the external (e.g., ambient) environment by moving fluid from bladder 700 to fluid transfer control system 900 via line 5010, and from there through valve 1020 (fluid line 5008 is closed during this operational state)—this operational state reduces pressure in bladder 700;

(e) moving fluid from a pump (e.g., pump 500, pump 800) to a foot support bladder 700 by moving fluid from pump 800 into fluid transfer control system 900 and from there into foot support bladder 700 via line 5010 (fluid line 5008 and valve 1020 are closed during this operational state)—this operational state increases pressure in bladder 700; and/or (f) moving fluid from the reservoir 400 to the external (e.g., ambient) environment by moving fluid from reservoir 400 to fluid transfer control system 900 via line 5008, and from there to the ambient environment via valve 1020 (fluid line 5010 is closed during this operational state)—this operational state decreases pressure in reservoir 400.

If desired, the example system 6000 of FIG. 6 may include additional foot support bladders (e.g., like 700A described above), and the fluid transfer control system 900 may include additional lines (e.g., like 5012 described above) for connection to it. Such a system could include additional operational states, e.g., to inflate and/or deflate the additional bladder(s) 700A, e.g., from pump(s) 500, 800, from reservoir 400, from another bladder 700, etc. Additionally or alternatively, if desired, system 6000 of FIG. 6 could include one or more additional operational states. As some more specific examples: (a) an operational state may be provided in which reservoir 400 and foot support bladder 700 are inflated simultaneously (e.g., by connecting pump 800 to lines 5008 and 5010 through fluid transfer control system 900 while valve 1020 is closed) and/or (b) an operational state may be provided in which reservoir 400 and foot support bladder 700 are deflated simultaneously (e.g., by connecting lines 5008 and 5010 to valve 1020 through fluid transfer control system 900). If desired, in the system 6000 of FIG. 6, one or more of the additional over-pressure release valves 500P, 800P, 400P, and 706 (shown in broken lines in FIG. 6) still may be provided (e.g., as extra protection against over-inflation of the system 6000) or one or more may be omitted.

In addition or as an alternative to the structures described above, fluid transfer control system 900 may include the various manually and/or electronically controlled switching systems, fluid paths, and/or component parts as described in any of U.S. Provisional Patent Appln. No. 62/463,859, U.S. Provisional Patent Appln. No. 62/463,892, U.S. Provisional Patent Appln. No. 62/850,140, U.S. Provisional Patent Appln. No. 62/678,662, and U.S. patent application Ser. No. 16/425,356, each of which is entirely incorporated herein by reference. The control system 900 may include one or more solenoid valves, one or more stem valves (e.g., activated by a movable cam within a housing or manifold), a rotatable cylinder or other movable base component structure defining multiple paths through its interior (e.g., located within a housing or manifold), a switching mechanism, and/or other suitable structures to selectively connect fluid lines from the pump 800, reservoir 400, bladder 700 (one or more), and ambient environment to one another—through the fluid transfer control system 900—to allow fluid communication between one or more of the above operational states.

As some further potential structures, the fluid transfer control system 900 may include a motor driven body, such as a cylinder, located within a housing or manifold. The driven body may include internal pathways defined through it, and these pathways include openings at the outer surface of the driven body. The housing or manifold may include ports in fluid communication (e.g., aligned) with fluid lines that extend to the pump 800, reservoir 400, bladder 700, and valve 1020. In some discrete positions of the driven body within the housing or manifold, these openings may be positioned so that: (a) at least two of the openings of the driven body align with the ports of the housing or manifold to place the fluid paths extending from the ports in fluid communication with one another (i.e., so that fluid flows through the driven body from one port to the other); and (b) other openings of the driven body are sealed off. By driving the driven body to different positions within the housing or manifold (e.g., by a motor rotating, linearly translating, or otherwise moving the driven body with respect to the housing or manifold), fluid paths between the different ports can be selectively opened through the driven body and other fluid paths through the driven body may be sealed. In this manner, one or more of the various operational states (e.g., the six operational states described above) can be selectively activated by locating the driven body within the housing or manifold of the fluid transfer control system 900 at a specific position.

Fluid transfer control systems 900 that may be used in at least some examples of this technology and of the types described above may include one or more solenoid based actuators to control the fluid flow. Some examples of such solenoid based actuators and solenoid based systems that include fluid paths defined through them are described, for example, in U.S. Provisional Patent Appln. No. 62/547,941 filed Aug. 21, 2017 and U.S. patent application Ser. No. 16/105,170 filed Aug. 20, 2018, each entitled "Adjustable Foot Support Systems Including Fluid-Filled Bladder Chambers." Each of U.S. Provisional Patent Appln. No. 62/547,941 and U.S. patent application Ser. No. 16/105,170 is entirely incorporated herein by reference.

Additionally or alternatively, if desired, fluid transfer control systems 900 that may be used in at least some examples of this technology and of the types described above may include solenoid valves/cylinders having latching features, e.g., magnetic latching. For example, in fluid transfer control systems, a movable valve component may move to open or close a valve and/or a fluid path to allow or stop fluid flow, respectively, through the valve. When the movable valve component blocks the path, fluid flow is stopped through that path and when the movable valve component is moved away from the path, fluid flow is allowed through the path. A biasing member, such as a spring, may bias the movable valve component in one of the open position or the closed position. For electronically controlled systems, power (e.g., battery power) may be needed to move the movable valve component from its biased position (where no power is needed to hold it in place because of the biasing force) to the opposite position (in which the movable valve component must be held in place opposing the biasing force). Some continuing "holding force" is needed to hold the movable valve component in the place where it opposes the biasing force and to maintain the movable valve component in that "opposite position." If the movable valve component needs to be held in this "opposite position" for a substantial time, this may drain significant power from the battery quickly.

Thus, fluid flow control systems 900 in accordance with some aspects of this technology may include: (a) a movable valve component of the types described above made, at least in part, from a magnetic attracted material (or even a magnet) and (b) a switch that moves a separate magnet between two or more discrete positions (e.g., an activated position and a deactivated position). With the switch in the "activated" position, the magnet associated with the switch is physically moved to a location where it interacts with the movable valve body with sufficient magnetic force (e.g., magnetic attraction) to pull the movable valve body to and hold it in the "opposite position" in opposition to the biasing force. In the "deactivated" position, the magnet is physically moved to a location where its magnetic attractive force is insufficient to hold the movable valve body against the biasing force (and thus the movable valve body moves to the biased position under the biasing force). Rather than move a magnet, the switch could move shielding material between the magnet and the movable valve body. In these systems, use of battery power may be limited to power needed to move the switch (and/or the magnet or shielding material associated with it) between the activated position and the deactivated position. In this manner, the movable valve body may be held in both the biased position and the opposite position for long time periods with minimal power consumption. Additionally or alternatively, if desired, magnet based systems of the types described in U.S. Provisional Patent Appln. No. 62/678,635 filed May 31, 2018 and U.S. patent application Ser. No. 14/425,331, filed May 29, 2019, each entitled "Fluid Flow Control Devices Usable in Adjustable Foot Support Systems" may be used in fluid transfer control system 900. Each of U.S. Provisional Patent Appln. No. 62/678,635 and U.S. patent application Ser. No. 14/425,331 is entirely incorporated herein by reference. As yet additional or other alternative features, movable valve bodies and/or movable solenoid parts may be moved to selectively open and close various fluid flow paths by a servo drive, linear motor, stepper motor, ball screw, lead screw, linear guide, or the like.

FIGS. 1B and 2A illustrate sole structures 104 in which the foot support bladder 700 is vertically stacked above the pumping systems 500, 800, and the reservoir 400. Other structural options are possible. For example, rather than having reservoir 400 and foot support bladder(s) 700 vertically stacked, reservoir 400 could be longitudinally spaced from the foot support bladder 700 (but optionally at the same or overlapping vertical level). As a more specific example, if desired, the reservoir 400 could be located in the heel area and/or midfoot area of the sole member 104 while the foot support bladder(s) 700 may be located in the forefoot area and/or midfoot area of the sole member 104. Additionally or alternatively, if desired, at least some portion (and optionally all) of the reservoir 400 may be included as part of the footwear upper 102 or engaged with the footwear upper 102. In such structures, the foot support bladder(s) 700 may support all or any one or more portions of the plantar surface of a wearer's foot (e.g., one or more of the heel area, the midfoot area, the forefoot area, the lateral side, the medial side, etc.). Foot support systems 1000, 4000, 5000, 6000 described above may include any of these types of physical and/or relative reservoir 400 and bladder 700 arrangements.

In some examples of this technology, the reservoir 400 may be maintained at a relatively constant pressure and/or at a pressure within the range of 20 to 35 psi. Additionally or alternatively, if desired, pressure in the foot support bladder(s) 700 may be varied, e.g., over a range of 5 to 22 psi, and this pressure may be controlled manually or electronically (e.g., by control of fluid transfer control system 900). Pressure sensors may be provided, as described above, as inputs to computer control systems for maintaining, setting, and/or changing these pressures in reservoir 400 and bladder 700, e.g., via fluid transfer control system 900.

III. CONCLUSION

For avoidance of doubt, the present application includes, but is not limited to, the subject-matter described in the following numbered clauses:

Clause 1. A sole structure for an article of footwear, comprising:

a first pump including a first inlet and a first outlet in fluid communication with a first internal pump chamber defined by the first pump, wherein the first internal pump chamber includes an open space defined, at least in part, between a first wall and a second wall located opposite the first wall, wherein at least one of the first wall or the second wall is collapsible to decrease volume of the first internal pump chamber and force fluid to exit the first internal pump chamber via the first outlet;

a first sole component having a first major surface and a second major surface opposite the first major surface, wherein the second major surface includes a first pump containing region, and wherein the first pump containing region defines a first pump engaging surface configured to lie immediately adjacent an exterior side of the first wall of the first internal pump chamber; and a second sole component having a third major surface and a fourth major surface opposite the third major surface, wherein the fourth major surface includes a second pump containing region, and wherein the second pump containing region defines a second pump engaging surface configured to lie immediately adjacent an exterior side of the second wall of the first internal pump chamber.

Clause 2. The sole structure according to clause 1, wherein the first internal pump chamber has an ellipsoidal and/or spheroidal shape, wherein the first pump engaging surface has a semi-ellipsoidal and/or semi-spheroidal shape, and/or wherein the second pump engaging surface has a semi-ellipsoidal and/or semi-spheroidal shape.

Clause 3. The sole structure according to clause 1 or clause 2, wherein the first major surface of the first sole component is a ground facing surface of the sole structure and includes a first protrusion located opposite the first pump engaging surface.

Clause 4. The sole structure according to any one of clauses 1 to 3, wherein at least a portion of the first pump engaging surface of the first pump containing region is fixed to the exterior side of the first wall of the first internal pump chamber.

Clause 5. The sole structure according to any one of clauses 1 to 4, wherein at least a portion of the second pump engaging surface of the second pump containing region is fixed to the exterior side of the second wall of the first internal pump chamber.

Clause 6. The sole structure according to any one of clauses 1 to 5, further comprising:

a bladder in fluid communication with the first outlet of the first pump.

Clause 7. The sole structure according to clause 6, wherein at least a portion of the bladder is located between (and optionally in direct contact with one or both of) the second major surface of the first sole component and the fourth major surface of the second sole component.

Clause 8. The sole structure according to clause 6, wherein at least a portion of the bladder is located adjacent the third major surface of the second sole component.

Clause 9. The sole structure according to any one of clauses 1 to 5, further comprising:

a second pump including a second inlet and a second outlet in fluid communication with a second internal pump chamber defined by the second pump, wherein the second internal pump chamber includes an open space defined, at least in part, between a third wall and a fourth wall located opposite the third wall, wherein at least one of the third wall or the fourth wall is collapsible to decrease volume of the second internal pump chamber and force fluid to exit the second internal pump chamber via the second outlet, and wherein the second inlet is in fluid communication with the first outlet to admit fluid pumped from the first pump into the second internal pump chamber.

Clause 10. The sole structure according to clause 9, further comprising a first fluid transfer line having a first end engaged with the first outlet and a second end engaged with the second inlet.

Clause 11. The sole structure according to clause 9 or clause 10, wherein the second major surface of the first sole component includes a third pump containing region, and wherein the third pump containing region defines a third pump engaging surface configured to lie immediately adjacent an exterior side of the third wall of the second internal pump chamber.

Clause 12. The sole structure according to any one of clauses 9 to 11, wherein the fourth major surface of the second sole component includes a fourth pump containing region, and wherein the fourth pump containing region defines a fourth pump engaging surface configured to lie immediately adjacent an exterior side of the fourth wall of the second internal pump chamber.

Clause 13. The sole structure according to clause 9 or 10, further comprising:

a third sole component having a fifth major surface and a sixth major surface opposite the fifth major surface, wherein the sixth major surface includes a third pump containing region, and wherein the third pump containing region defines a third pump engaging surface configured to lie immediately adjacent an exterior side of the third wall of the second internal pump chamber; and a fourth sole component having a seventh major surface and an eighth major surface opposite the seventh major surface, wherein the eighth major surface includes a fourth pump containing region, and wherein the fourth pump containing region defines a fourth pump engaging surface configured to lie immediately adjacent an exterior side of the fourth wall of the second internal pump chamber.

Clause 14. The sole structure according to clause 9 or 10, further comprising:

a third sole component having a fifth major surface and a sixth major surface opposite the fifth major surface, wherein the sixth major surface includes a third pump containing region, and wherein the third pump containing region defines a third pump engaging surface configured to lie immediately adjacent an exterior side of the third wall of the second internal pump chamber; and wherein the fourth major surface of the second sole component includes a fourth pump containing region, and wherein the fourth pump containing region defines a fourth pump engaging surface configured to lie immediately adjacent an exterior side of the fourth wall of the second internal pump chamber.

Clause 15. The sole structure according to clause 9 or 10, further comprising:

a third sole component having a fifth major surface and a sixth major surface opposite the fifth major surface, wherein the sixth major surface includes a third pump containing region, and wherein the third pump containing region defines a third pump engaging surface configured to lie immediately adjacent an exterior side of the third wall of the second internal pump chamber; and wherein the second major surface of the first sole component includes a fourth pump containing region, and wherein the fourth pump containing region defines a fourth pump engaging surface configured to lie immediately adjacent an exterior side of the fourth wall of the second internal pump chamber.

Clause 16. The sole structure according to any one of clauses 11 to 15, wherein at least a portion of the third pump engaging surface of the third pump containing region is fixed to the exterior side of the third wall of the second internal pump chamber.

Clause 17. The sole structure according to any one of clauses 12 to 16, wherein at least a portion of the fourth pump engaging surface of the fourth pump containing region is fixed to the exterior side of the fourth wall of the second internal pump chamber.

Clause 18. The sole structure according to any one of clauses 9 to 17, wherein the second internal pump chamber has an ellipsoidal and/or spheroidal shape, wherein the third pump engaging surface has a semi-ellipsoidal and/or semi-spheroidal shape, and/or wherein the fourth pump engaging surface has a semi-ellipsoidal and/or semi-spheroidal shape.

Clause 19. The sole structure according to any one of clauses 9 to 18, wherein the first major surface of the first sole component is a ground facing surface of the sole structure and includes a protrusion located and configured to activate the second pump.

Clause 20. The sole structure according to any one of clauses 9 to 19, further comprising a bladder in fluid communication with the second outlet of the second pump.

Clause 21. The sole structure according to clause 20, wherein at least a portion of the bladder is located between the second major surface of the first sole component and the fourth major surface of the second sole component.

Clause 22. The sole structure according to clause 20 or clause 21, further comprising: a foot support bladder in fluid communication with the bladder that is in fluid communication with the second outlet of the second pump.

Clause 23. The sole structure according to clause 22, wherein at least a portion of the foot support bladder is located adjacent the third major surface of the second sole component.

Clause 24. The sole structure according to clause 20, wherein at least a portion of the bladder is located adjacent the third major surface of the second sole component.

Clause 25. The sole structure according to any one of clauses 9 to 24, wherein the second pump is a compressible bulb pump.

Clause 26. The sole structure according to any one of clauses 9 to 25, wherein the first pump is located in a heel region of the sole structure and the second pump is located in a forefoot region of the sole structure.

Clause 27. The sole structure according to any one of clauses 9 to 26, wherein the first sole component is an outsole component and/or the second sole component is a foam midsole component.

Clause 28. The sole structure according to any one of clauses 9 to 26, wherein the first sole component is an outsole component and/or the second sole component is a foot support plate.

Clause 29. The sole structure according to any one of clauses 1 to 8, 27, or 28, wherein the first pump is located in a heel region of the sole structure.

Clause 30. The sole structure according to any one of clauses 1 to 8, 27, or 28, wherein the first pump is located in a forefoot region of the sole structure.

Clause 31. The sole structure according to any one of clauses 1 to 30, wherein the first pump is a compressible bulb pump.

Clause 32. An article of footwear, comprising:

an upper; and a sole structure according to any one of clauses 1 to 31 engaged with the upper.

Clause 33. A fluid transfer system for an article of footwear, comprising:

a first pump including a first pump chamber, a first inlet, and a first outlet;

a first fluid transfer line connected to the first inlet and connecting the first pump with an external fluid source, wherein the first fluid transfer line moves fluid from the external fluid source into the first pump chamber via the first inlet;

a second pump including a second pump chamber, a second inlet, and a second outlet;

a second fluid transfer line connected to the second inlet and admitting fluid discharged from the first outlet into the second pump chamber via the second inlet;

a third fluid transfer line connected to the second outlet and receiving fluid discharged from the second pump chamber; and a bladder in fluid communication with the third fluid transfer line and receiving fluid discharged from the second pump chamber via the second outlet.

Clause 34. The fluid transfer system according to clause 33, further comprising a first valve provided in fluid communication with the first fluid transfer line connected to allow fluid to move from the external fluid source to the first inlet and to inhibit fluid from moving from the first inlet through the first valve.

Clause 35. The fluid transfer system according to clause 33 or clause 34, wherein the external fluid source is an ambient air source.

Clause 36. The fluid transfer system according to any one of clauses 33 to 35, wherein the bladder is a foot support bladder for an article of footwear.

Clause 37. The fluid transfer system according to any one of clauses 33 to 35, wherein the bladder is a reservoir bladder.

Clause 38. The fluid transfer system according to clause 37, further comprising: a foot support bladder; and a fluid transfer control system for moving fluid from the bladder to the foot support bladder.

Clause 39. The fluid transfer system according to any one of clauses 33 to 38, wherein at least one of the first pump or the second pump is a compressible bulb pump.

Clause 40. An article of footwear, comprising:

an upper;

a sole structure engaged with the upper; and a fluid transfer system according to any one of clauses 33 to 39 engaged with at least one of the upper or the sole structure.

Clause 41. The article of footwear according to clause 40, wherein the sole structure and/or the fluid transfer system include structure according to any one of clauses 1 to 31.

Clause 42. A foot support system, comprising:

a first bladder including an interior volume for containing fluid, a first longitudinal area, and a second longitudinal area located forward of the first longitudinal area;

a first pump including a first pump chamber, a first inlet, and a first outlet, wherein the first pump is located at or adjacent the first longitudinal area of the first bladder;

a first fluid transfer line connected to the first inlet and connecting the first pump with an external fluid source, wherein the first fluid transfer line moves fluid from the external fluid source into the first pump chamber via the first inlet;

a second pump including a second pump chamber, a second inlet, and a second outlet, wherein the second pump is located at or adjacent the second longitudinal area of the first bladder;

a second fluid transfer line connected to the second inlet and admitting fluid discharged from the first outlet into the second pump chamber via the second inlet; and a third fluid transfer line connected to the second outlet and receiving fluid discharged from the second pump chamber, wherein the first bladder is in fluid communication with the second pump at least in part via the third fluid transfer line.

Clause 43. The foot support system according to clause 42, wherein the second longitudinal area is located in a forefoot region of the foot support system.

Clause 44. The foot support system according to clause 42 or clause 43, wherein the first longitudinal area is located in a heel region of the foot support system.

Clause 45. The foot support system according to clause 42, wherein the second longitudinal area is located in a forefoot region of the foot support system, and wherein the second pump chamber is configured to be compressed in response to downward force applied by a wearer's forefoot.

Clause 46. The foot support system according to clause 42 or clause 45, wherein the first longitudinal area is located in a heel region of the foot support system, and wherein the first pump chamber is configured to be compressed in response to downward force applied by a wearer's heel.

Clause 47. The foot support system according to any one of clauses 42 to 46, further comprising: a second bladder; and a fluid transfer control system connecting the first bladder with the second bladder.

Clause 48. The foot support system according to any one of clauses 42 to 47, further comprising: a sole component, wherein the first bladder is engaged with the sole component and forms at least a portion of a plantar support surface for a wearer's foot.

Clause 49. The foot support system according to any one of clauses 42 to 48, wherein at least one of the first pump or the second pump is a compressible bulb pump.

Clause 50. The foot support system according to any one of clauses 42 to 49, wherein the first bladder includes a lateral side portion located on a lateral side of the first pump and a medial side portion located on a medial side of the first pump.

Clause 51. The foot support system according to any one of clauses 42 to 50, wherein the first bladder includes a lateral side portion located on a lateral side of the second pump and a medial side portion located on a medial side of the second pump.

Clause 52. An article of footwear, comprising:

an upper;

a sole structure engaged with the upper, wherein the sole structure includes a foot support system according to any one of clauses 42 to 51.

Clause 53. The article of footwear according to clause 52, wherein the sole structure includes structure according to any one of clauses 1 to 31.

Clause 54. A foot support system, comprising:

a fluid transfer control system including a first port, a second port, a third port, and a fourth port, wherein the fourth port is in fluid communication with an external environment;

a first pump connected to the first port;

a reservoir connected to the second port; and a foot support bladder connected to the third port, wherein the fluid transfer control system selectively places the foot support system in any one of six operational states as follows:

(a) a first operational state in which fluid moves from the first pump, into the fluid transfer control system, and through the fourth port to the external environment;

(b) a second operational state in which fluid moves from the first pump, into the fluid transfer control system, and through the second port to the reservoir;

(c) a third operational state in which fluid moves from the reservoir, through the fluid transfer control system, and through the third port to the foot support bladder;

(d) a fourth operational state in which fluid moves from the foot support bladder, through the fluid transfer control system, and through the fourth port to the external environment;

(e) a fifth operational state in which fluid moves from the pump, through the fluid transfer control system, and through the third port to foot support bladder; and (f) a sixth operational state in which fluid moves from the reservoir, through the fluid transfer control system, and through the fourth port to the external environment.

Clause 55. The foot support system according to Clause 54, further comprising: a second pump, wherein the second pump supplies fluid to the first pump.

Clause 56. The foot support system according to Clause 55, further comprising: a filter positioned to filter incoming fluid before it enters the second pump.

Clause 57. The foot support system according to Clause 54, further comprising: a fluid inlet line connected to the first pump.

Clause 58. The foot support system according to Clause 57, further comprising: a filter positioned to filter incoming fluid before it enters the fluid inlet line.

Clause 59. The foot support system according to any one of Clauses 54 to 58, further comprising: a second foot support bladder, wherein the fluid transfer control system includes a fifth port in fluid communication with the second foot support bladder.

Clause 60. A foot support system, comprising:

a fluid transfer control system including a first port, a second port, and a third port, wherein the third port is in fluid communication with an external environment;

a reservoir connected to the first port;

a first pump in fluid communication with the reservoir; and a foot support bladder connected to the second port, wherein the fluid transfer control system selectively places the foot support system in any one of five operational states as follows:

(a) a first operational state in which fluid moves from the first pump, through the reservoir, into the fluid transfer control system, and through the third port to the external environment;

(b) a second operational state in which fluid moves from the reservoir, through the fluid transfer control system, and through the second port to the foot support bladder;

(c) a third operational state in which fluid moves from the foot support bladder, through the fluid transfer control system, and through the third port to the external environment;

(d) a fourth operational state in which fluid moves from the pump, through the reservoir, through the fluid transfer control system, and through the second port to foot support bladder; and (e) a fifth operational state in which fluid moves from the reservoir, through the fluid transfer control system, and through the third port to the external environment.

Clause 61. The foot support system according to Clause 60, further comprising: a second pump, wherein the second pump supplies fluid to the first pump.

Clause 62. The foot support system according to Clause 61, further comprising: a filter positioned to filter incoming fluid before it enters the second pump.

Clause 63. The foot support system according to Clause 60, further comprising: a fluid inlet line connected to the first pump.

Clause 64. The foot support system according to Clause 63, further comprising: a filter positioned to filter incoming fluid before it enters the fluid inlet line.

Clause 65. The foot support system according to any one of Clauses 60 to 64, further comprising: a second foot support bladder, wherein the fluid transfer control system includes a fourth port in fluid communication with the second foot support bladder.

Clause 66. The foot support system according to any one of Clauses 54 to 65, wherein the fluid transfer control system includes a motor driven body that is movable to a discrete position to open a fluid path through the fluid transfer control system connecting two of the ports.

Clause 67. The foot support system according to any one of Clauses 54 to 65, wherein the fluid transfer control system includes a motor driven body that is movable to a discrete position to open a fluid path through the motor driven body connecting two of the ports.

Clause 68. The foot support system according to any one of Clauses 54 to 65, wherein the fluid transfer control system includes a motor driven body that is movable to a plurality of discrete positions, wherein the individual positions of the plurality of discrete positions open different fluid paths through the fluid transfer control system connecting different sets of two of the ports.

Clause 69. The foot support system according to any one of Clauses 54 to 65, wherein the fluid transfer control system includes a motor driven body that is movable to a plurality of discrete positions, wherein the individual positions of the plurality of discrete positions open different fluid paths through the motor driven body connecting different sets of two of the ports.

Clause 70. The foot support system according to any one of Clauses 66 to 69, wherein the motor driven body is a rotatable cylinder.

Clause 71. The foot support system according to any one of Clauses 54 to 70, wherein the fluid transfer control system includes at least one solenoid based actuator.

Clause 72. The foot support system according to any one of Clauses 54 to 70, wherein the fluid transfer control system includes at least one solenoid or other valve activated by a switch to change a fluid flow path from an open configuration to a closed configuration.

Clause 73. The foot support system according to Clause 72, wherein the switch moves a magnet between: (a) a first discrete position where the magnet moves a movable valve body under magnetic attractive force to one of a fluid path open position or a fluid path closed position and (b) a second discrete position where magnetic attractive force on the movable valve body from the magnet is insufficient to move the movable valve body thereby positioning the movable valve body in the other of the fluid path open position or the fluid path closed position.

Clause 74. The foot support system according to any one of Clauses 54 to 73, wherein the fluid transfer control system has any of the structures and/or properties described for component 900 above.

Clause 75. A sole structure, comprising:

a sole component; and a foot support system according to any one of Clauses 54 to 74, wherein at least one of the first pump, the reservoir, or the foot support bladder is engaged with the sole component.

Clause 76. The sole structure according to Clause 75, wherein the sole component is a midsole element or an outsole element.

Clause 77. An article of footwear comprising:

an upper;

a sole structure engaged with the upper; and a foot support system according to any one of Clauses 54 to 74, wherein the foot support bladder is engaged with the sole structure.

Clause 78. The article of footwear according to Clause 77, wherein the first pump in engaged with the sole structure.

Clause 79. The article of footwear according to Clause 77 or 78, wherein the reservoir is at least partially engaged with the sole structure.

Clause 80. The article of footwear according to any one of Clauses 77 to 79, wherein the reservoir is at least partially engaged with the upper.

Clause 81. The article of footwear according to any one of Clauses 77 to 80, wherein the fluid transfer control system is at least partially engaged with the upper.

The present invention is disclosed above and in the accompanying drawings with reference to a variety of examples. The purpose served by the disclosure, however, is to provide examples of various features and concepts related to the invention, not to limit the scope of the invention. One skilled in the relevant art will recognize that numerous variations and modifications may be made to the examples described above without departing from the scope of the present invention, as defined by the appended claims.

What is claimed is:

1. A foot support system, comprising:

a fluid transfer control system including a first port, a second port, a third port, and a fourth port, wherein the fourth port is in fluid communication with an external environment;

a first pump connected to the first port, wherein the first pump is a compressible bulb pump;

a reservoir connected to the second port; and a foot support bladder connected to the third port, wherein the fluid transfer control system is configured to selectively place the foot support system in each of six operational states as follows:

(a) a first operational state in which fluid moves from the first pump, into the fluid transfer control system, and through the fourth port to the external environment;

(b) a second operational state in which fluid moves from the first pump, into the fluid transfer control system, and through the second port to the reservoir;

(c) a third operational state in which fluid moves from the reservoir, through the fluid transfer control system, and through the third port to the foot support bladder;

(d) a fourth operational state in which fluid moves from the foot support bladder, through the fluid transfer control system, and through the fourth port to the external environment;

(e) a fifth operational state in which fluid moves from the first pump, through the fluid transfer control system, and through the third port to the foot support bladder; and (f) a sixth operational state in which fluid moves from the reservoir, through the fluid transfer control system, and through the fourth port to the external environment.

2. The foot support system according to claim 1, further comprising: a fluid inlet line connected to the first pump.

3. The foot support system according to claim 1, further comprising: a second foot support bladder, wherein the fluid transfer control system includes a fifth port in fluid communication with the second foot support bladder.

4. The foot support system according to claim 1, wherein the first pump is located in a heel region of the foot support system.

5. The foot support system according to claim 1, wherein the first pump is located in a forefoot region of the foot support system.

6. The foot support system according to claim 1, wherein the fluid transfer control system includes a programmable controller and/or one or more electronically controlled valves.

7. A foot support system, comprising:

a fluid transfer control system including a first port, a second port, a third port, and a fourth port, wherein the fourth port is in fluid communication with an external environment;

a first pump connected to the first port;

a second pump, wherein the second pump supplies fluid to the first pump;

a reservoir connected to the second port; and a foot support bladder connected to the third port, wherein the fluid transfer control system is configured to selectively place the foot support system in each of six operational states as follows:

(a) a first operational state in which fluid moves from the first pump, into the fluid transfer control system, and through the fourth port to the external environment;

(b) a second operational state in which fluid moves from the first pump, into the fluid transfer control system, and through the second port to the reservoir;

(c) a third operational state in which fluid moves from the reservoir, through the fluid transfer control system, and through the third port to the foot support bladder;

(d) a fourth operational state in which fluid moves from the foot support bladder, through the fluid transfer control system, and through the fourth port to the external environment;

(e) a fifth operational state in which fluid moves from the first pump, through the fluid transfer control system, and through the third port to the foot support bladder; and (f) a sixth operational state in which fluid moves from the reservoir, through the fluid transfer control system, and through the fourth port to the external environment.

8. The foot support system according to claim 7, wherein the second pump is a compressible bulb pump.

9. The foot support system according to claim 7, wherein the second pump is located in a heel region of the foot support system and the first pump is located in a forefoot region of the foot support system.

10. The foot support system according to claim 7, wherein the first pump is a first compressible bulb pump and the second pump is a second compressible bulb pump.

11. A foot support system, comprising:

a fluid transfer control system including a first port, a second port, and a third port, wherein the third port is in fluid communication with an external environment;

a reservoir connected to the first port;

a first pump in fluid communication with the reservoir, wherein the first pump is a compressible bulb pump; and a foot support bladder connected to the second port, wherein the fluid transfer control system is configured to selectively place the foot support system in each of five operational states as follows:

(a) a first operational state in which fluid moves from the first pump, through the reservoir, into the fluid transfer control system, and through the third port to the external environment;

(b) a second operational state in which fluid moves from the reservoir, through the fluid transfer control system, and through the second port to the foot support bladder;

(c) a third operational state in which fluid moves from the foot support bladder, through the fluid transfer control system, and through the third port to the external environment;

(d) a fourth operational state in which fluid moves from the first pump, through the reservoir, through the fluid transfer control system, and through the second port to foot support bladder; and (e) a fifth operational state in which fluid moves from the reservoir, through the fluid transfer control system, and through the third port to the external environment.

12. The foot support system according to claim 11, further comprising: a fluid inlet line connected to the first pump.

13. The foot support system according to claim 11, further comprising: a second foot support bladder, wherein the fluid transfer control system includes a fourth port in fluid communication with the second foot support bladder.

14. The foot support system according to claim 11, wherein the first pump is located in a heel region or in a forefoot region of the foot support system.

15. The foot support system according to claim 11, wherein the fluid transfer control system includes a programmable controller and/or one or more electronically controlled valves.

16. A foot support system, comprising:

a fluid transfer control system including a first port, a second port, and a third port, wherein the third port is in fluid communication with an external environment;

a reservoir connected to the first port;

a first pump in fluid communication with the reservoir;

a second pump, wherein the second pump supplies fluid to the first pump; and a foot support bladder connected to the second port, wherein the fluid transfer control system is configured to selectively place the foot support system in each of five operational states as follows:

(a) a first operational state in which fluid moves from the first pump, through the reservoir, into the fluid transfer control system, and through the third port to the external environment;

(b) a second operational state in which fluid moves from the reservoir, through the fluid transfer control system, and through the second port to the foot support bladder;

(c) a third operational state in which fluid moves from the foot support bladder, through the fluid transfer control system, and through the third port to the external environment;

(d) a fourth operational state in which fluid moves from the first pump, through the reservoir, through the fluid transfer control system, and through the second port to foot support bladder; and (e) a fifth operational state in which fluid moves from the reservoir, through the fluid transfer control system, and through the third port to the external environment.

17. The foot support system according to claim 16, wherein the second pump is a compressible bulb pump.

18. The foot support system according to claim 16, wherein the second pump is located in a heel region of the foot support system and the first pump is located in a forefoot region of the foot support system.

19. The foot support system according to claim 16, wherein the first pump is a first compressible bulb pump and the second pump is a second compressible bulb pump.

20. A sole structure, comprising:

a sole component; and a foot support system including:

(a) a fluid transfer control system including a first port, a second port, a third port, and a fourth port, wherein the fourth port is in fluid communication with an external environment;

(b) a first pump connected to the first port;

(c) a second pump, wherein the second pump supplies fluid to the first pump;

(d) a reservoir connected to the second port; and (e) a foot support bladder connected to the third port, wherein at least one of the first pump, the reservoir, or the foot support bladder is engaged with the sole component, and wherein the fluid transfer control system is configured to selectively place the foot support system in each of six operational states as follows:

(i) a first operational state in which fluid moves from the first pump, into the fluid transfer control system, and through the fourth port to the external environment;

(ii) a second operational state in which fluid moves from the first pump, into the fluid transfer control system, and through the second port to the reservoir;

(iii) a third operational state in which fluid moves from the reservoir, through the fluid transfer control system, and through the third port to the foot support bladder;

(iv) a fourth operational state in which fluid moves from the foot support bladder, through the fluid transfer control system, and through the fourth port to the external environment;

(v) a fifth operational state in which fluid moves from the first pump, through the fluid transfer control system, and through the third port to foot support bladder; and (vi) a sixth operational state in which fluid moves from the reservoir, through the fluid transfer control system, and through the fourth port to the external environment.

* * * * *